US010384470B2

(12) United States Patent
Yamane et al.

(10) Patent No.: US 10,384,470 B2
(45) Date of Patent: Aug. 20, 2019

(54) INK JET RECORDING APPARATUS AND INK JET RECORDING METHOD

(71) Applicant: CANON KABUSHIKI KAISHA, Tokyo (JP)

(72) Inventors: Toru Yamane, Yokohama (JP); Akihiro Mouri, Fuchu (JP); Hiroaki Motooka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,559

(22) Filed: Jun. 29, 2018

(65) Prior Publication Data

US 2018/0319179 A1 Nov. 8, 2018

Related U.S. Application Data

(63) Continuation of application No. PCT/JP2016/005242, filed on Dec. 28, 2016.

(30) Foreign Application Priority Data

Jan. 5, 2016 (JP) ..... 2016-000745
May 27, 2016 (JP) ..... 2016-106239

(51) Int. Cl.
*B41J 2/17* (2006.01)
*B41J 11/00* (2006.01)
*B41J 2/01* (2006.01)

(52) U.S. Cl.
CPC ..... *B41J 11/0015* (2013.01); *B41J 2/01* (2013.01); *B41J 2/1714* (2013.01)

(58) Field of Classification Search
CPC ..... B41J 11/0015; B41J 2/01; B41J 2/1714; B41J 2/1721; B41J 2/18; B41J 2/185; B41J 2002/1728; B41J 2002/1742
See application file for complete search history.

(56) References Cited

U.S. PATENT DOCUMENTS 7,481,526 B2 1/2009 Inoue
7,494,213 B2 2/2009 Taniuchi et al.
(Continued)

FOREIGN PATENT DOCUMENTS

CN 1990241 A 7/2007
CN 101332708 A 12/2008
(Continued)

OTHER PUBLICATIONS

Google translation of JP 2009-086348, published on Apr. 2009 (Year: 2009).*
(Continued)

*Primary Examiner* — Huan H Tran
(74) *Attorney, Agent, or Firm* — Venable LLP

(57) ABSTRACT

An ink jet recording apparatus includes an image forming unit that forms a first image containing a first liquid and a coloring material on an ink receiving medium, a liquid absorbing member that has a porous body coming in contact with the first image and absorbing at least a part of the first liquid from the first image, and a liquid collecting device that collects the first liquid absorbed in the porous body. The porous body has a first surface that is a side contacting the first image, and a second surface opposing the first surface. An average pore size of the second surface of the porous body is larger than an average pore size of the first surface. In addition, the liquid collecting device includes a gas ejection member that ejects gas to the second surface of the porous body to extrude the first liquid from the second surface.

28 Claims, 17 Drawing Sheets

(56) References Cited

U.S. PATENT DOCUMENTS

| | | | | |
|---|---|---|---|---|
| 7,556,342 | B2 | 7/2009 | Hamano | |
| 7,766,457 | B2 | 8/2010 | Chen | |
| 7,845,760 | B2 | 12/2010 | Hirakawa | |
| 7,926,933 | B2 | 4/2011 | Taniuchi et al. | |
| 7,997,717 | B2 | 8/2011 | Taniuchi et al. | |
| 8,246,158 | B2 | 8/2012 | Ageishi et al. | |
| 9,616,653 | B2 | 4/2017 | Liu | |
| 9,796,171 | B2 | 10/2017 | Liu | |
| 10,137,690 | B2 | 11/2018 | Hirokawa et al. | |
| 2006/0221166 | A1 | 10/2006 | Inoue | |
| 2007/0229586 | A1 | 10/2007 | Hirakawa | |
| 2009/0079784 | A1 | 3/2009 | Chiwata et al. | |
| 2015/0306539 | A1 | 10/2015 | Yamato | |
| 2016/0185110 | A1 | 6/2016 | Masuda et al. | |
| 2018/0311951 | A1 | 11/2018 | Sakamoto et al. | |
| 2018/0326719 | A1 | 11/2018 | Masuda et al. | |
| 2018/0326755 | A1 | 11/2018 | Ohnishi et al. | |
| 2018/0326756 | A1 | 11/2018 | Hirokawa et al. | |
| 2018/0345702 | A1 | 12/2018 | Deguchi et al. | |
| 2019/0009521 | A1* | 1/2019 | Nishitani | B44C 1/165 |
| 2019/0009550 | A1 | 1/2019 | Inoue et al. | |
| 2019/0009578 | A1 | 1/2019 | Takeuchi et al. | |
| 2019/0009579 | A1 | 1/2019 | Inoue et al. | |
| 2019/0009589 | A1* | 1/2019 | Hirokawa | B41J 2/01 |
| 2019/0009601 | A1* | 1/2019 | Ohnishi | B41J 2/01 |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| CN | 105593020 | A | 5/2016 |
| JP | 2001-179959 | A | 7/2001 |
| JP | 2005-161610 | A | 6/2005 |
| JP | 2007-268974 | A | 10/2007 |
| JP | 2007-268975 | A | 10/2007 |
| JP | 4016559 | B2 | 12/2007 |
| JP | 2008-087283 | A | 4/2008 |
| JP | 2008-213333 | A | 9/2008 |
| JP | 2009-000915 | A | 1/2009 |
| JP | 2009-045851 | A | 3/2009 |
| JP | 2009-061644 | A | 3/2009 |
| JP | 2009-072927 | A | 4/2009 |
| JP | 2009-086348 | A | 4/2009 |
| JP | 2009-214439 | A | 9/2009 |
| JP | 2009-226852 | A | 10/2009 |
| JP | 2011-245865 | A | 12/2011 |
| JP | 2015-098097 | A | 5/2015 |
| JP | 2015-145117 | A | 8/2015 |
| JP | 2015-208881 | A | 11/2015 |
| JP | 2016-120625 | A | 7/2016 |
| WO | 2015034027 | A1 | 3/2015 |

OTHER PUBLICATIONS

Singapore Search Report and Written Opinion dated Sep. 17, 2018, in SG Patent Application No. 11201805829P.

International Preliminary Report on Patentability dated Jul. 19, 2018, in International Application No. PCT/JP2016/005242.

International Search Report and Written Opinion dated Mar. 7, 2017, in International Application No. PCT/JP2016/005242.

Office Action dated May 24, 2019, issued in Chinese Patent Application No. 201680078084.8.

Office Action issued in corresponding Chinese Patent Appln. No. 201680078027.X, dated Apr. 25, 2019.

Office Action issued in corresponding Chinese Patent Appln. No. 201680078100.3, dated Apr. 25, 2019.

Office Action issued in corresponding Chinese Patent Appln. No. 201680078028.4, dated Apr. 28, 2019.

* cited by examiner

INK JET RECORDING APPARATUS AND INK JET RECORDING METHOD

CROSS-REFERENCE TO RELATED APPLICATIONS

This application is a Continuation of International Patent Application No. PCT/JP2016/005242, filed Dec. 28, 2016, which claims the benefit of Japanese Patent Application No. 2016-000745, filed Jan. 5, 2016, and Japanese Patent Application No. 2016-106239, filed May 27, 2016, all of which are hereby incorporated by reference herein in their entireties.

BACKGROUND OF THE INVENTION

Field of the Invention

The present invention relates to an ink jet recording apparatus and an ink jet recording method.

Description of the Related Art

In an ink jet recording method, an image is formed by applying a liquid composition (ink) containing a coloring material directly or indirectly onto a recording medium such as paper. At this time, the recording medium excessively absorbs the liquid component in the ink so that curling or cockling may occur.

In this regard, in order to rapidly remove the liquid component in the ink, there are a method in which a recording medium is dried using a means such as hot air or infrared rays and a method in which an image is formed on a transfer body, a liquid component contained in the image on the transfer body is then dried by thermal energy or the like, and then the image is transferred to a recording medium such as paper.

Further, as a means for removing a liquid component contained in an image on a transfer body, a method has been proposed in which a roller provided with a permeable membrane only transmitting liquid to a front surface of an absorber is brought into contact with an ink image so that a liquid component is absorbed and removed from the ink image without using thermal energy (Japanese Patent Application Laid-Open No. 2005-161610).

In addition, a method has been proposed in which a belt-shaped polymer absorber is brought into contact with an ink image so that a liquid component is absorbed and removed from the ink image (Japanese Patent Application Laid-Open No. 2001-179959).

Further, in Japanese Patent Application Laid-Open Nos. 2005-161610 and 2001-179959, it is described that a mechanism collecting the liquid absorbed in the absorber is further provided. Japanese Patent Application Laid-Open No. 2005-161610 describes (1) a method in which the liquid absorbed in the absorber is reabsorbed by bringing a separate member such as a wick into contact with the absorber and is pressurized or squeezed. Japanese Patent Application Laid-Open No. 2001-179959 discloses (2) a method in which a mesh-shaped or porous belt is disposed at the inner side of the polymer absorber, a heater or a ventilation device is provided at the inner side of the belt, and the liquid absorbed in the polymer absorber is wicked out from the inner side. In addition, Japanese Patent Application Laid-Open No. 2001-179959 also proposes (3) a method in which a squeezing mechanism squeezing the liquid absorbed in the belt-shaped polymer absorber is provided.

In the ink jet recording apparatus, needs such as an increase in printing speed and an increase in size of a printed article have been increasing. Further, from the viewpoint of the image quality of the printed article, it is necessary to maintain the quality of the image after the liquid is absorbed to be constant. The means described in Japanese Patent Application Laid-Open Nos. 2005-161610 and 2001-179959 are not necessarily satisfactory with respect to such needs.

In the method (1) in Japanese Patent Application Laid-Open No. 2005-161610, it takes much time to reabsorb the liquid by the separate member (wick). In particular, with the configuration as in Japanese Patent Application Laid-Open No. 2005-161610, since the separate member is brought into contact with the absorber from the side of a printing medium, in a recording apparatus performing printing to a printing medium having a large width at a high speed, reabsorption speed does not follow the printing speed and thus practical application is not possible.

The polymer absorber in Japanese Patent Application Laid-Open No. 2001-179959 is excellent in the speed for absorbing the liquid but is inferior to discharge speed. Therefore, as the method (2) as in the embodiment of Japanese Patent Application Laid-Open No. 2001-179959, a method in which the liquid is thermally evaporated by heating with a heater or blowing hot air or the squeezing method (3) is needed. In the method of thermally evaporating the liquid content, large energy is required in a recording apparatus with a high printing speed, and since it takes time to dry the liquid, a long drying furnace or a wide range of hot air is required. In addition, in the squeezing method, elastic deformation occurs, and in view of the state of a contact surface with the image and stability of contact pressure, it may be difficult to maintain the quality of the image after the liquid is absorbed to be constant.

An object of the present invention is to provide an ink jet recording apparatus and an ink jet recording method which are capable of coping with an increase in printing speed, an increase in size of a printed article, and the like and providing a printed article with excellent image quality.

SUMMARY OF THE INVENTION

According to an embodiment of the present invention, provided is an ink jet recording apparatus including:

an image forming unit that forms a first image containing a first liquid and a coloring material on an ink receiving medium;

a liquid absorbing member that has a porous body coming in contact with the first image and absorbing at least a part of the first liquid from the first image; and a liquid collecting device that collects the first liquid absorbed in the porous body, wherein the porous body has a first surface that is a side contacting the first image and a second surface opposing the first surface and an average pore size of the second surface of the porous body is larger than an average pore size of the first surface, and the liquid collecting device includes a gas ejection member that ejects gas to the second surface of the porous body to extrude the first liquid from the second surface.

According to another embodiment of the present invention, provided is an ink jet recording method including:

an image forming step of forming a first image containing a first liquid and a coloring material on an ink receiving medium;

a liquid absorbing step of bringing a liquid absorbing member having a porous body into contact with the first image and absorbing at least a part of the first liquid from the first image by the porous body; and a liquid collecting step of collecting the absorbed first liquid from the porous body, wherein the porous body has a first surface that is a side contacting the first image and a second surface opposing the first surface and an average pore size of the second surface of the porous body is larger than an average pore size of the first surface, and the liquid collecting step is to eject gas to the second surface of the porous body, extrude the first liquid from the second surface, and collect the first liquid.

Further features of the present invention will become apparent from the following description of exemplary embodiments with reference to the attached drawings.

DESCRIPTION OF THE EMBODIMENTS

Figure 1A:
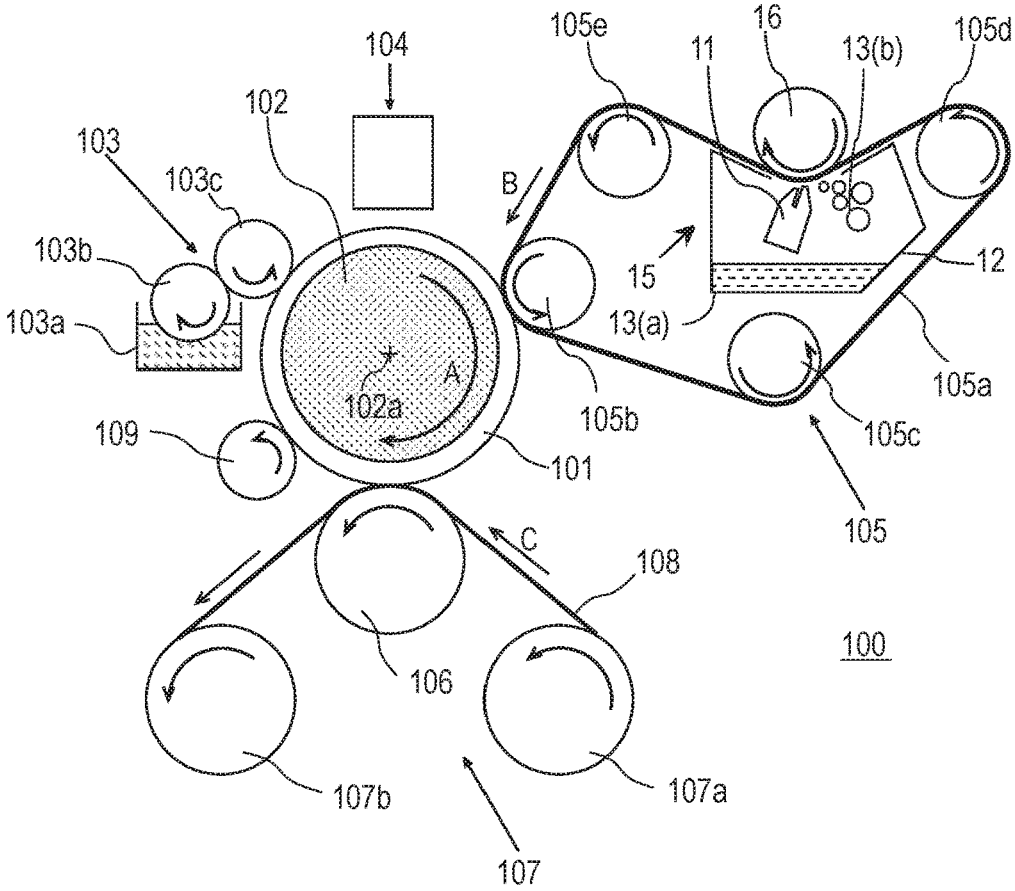
FIG. 1A is a schematic diagram illustrating an example of the configuration of a transfer type ink jet recording apparatus according to an embodiment of the present invention.

Hereinafter, the present invention will be described by means of preferred embodiments.

An ink jet recording apparatus of the present invention includes an image forming unit that forms a first image containing a first liquid and a coloring material on an ink receiving medium, and a liquid absorbing member that has a porous body coming in contact with the first image and absorbing at least a part of the first liquid from the first image. By bringing the liquid absorbing member having a porous body into contact with the first image containing a first liquid and a coloring material on the ink receiving medium, at least a part of the first liquid is removed from the first image. As a result, curling or cockling, which is caused by a recording medium such as paper excessively absorbing the first liquid in the first image, is suppressed.

In the ink jet recording apparatus of the present invention, the porous body has a first surface that is a side contacting the first image and a second surface opposing the first surface and an average pore size of the second surface of the porous body is larger than an average pore size of the first surface. Further, a liquid collecting device includes a gas ejection member that ejects gas to the second surface of the porous body to extrude the first liquid from the second surface.

In the ink jet recording apparatus of the present invention, the image forming unit is not particularly limited as long as the first image containing a first liquid and a coloring material can be formed on the ink receiving medium. Preferably, the image forming unit includes 1) a device that applies a first liquid composition, which contains the first liquid or a second liquid, onto the ink receiving medium and 2) a device that applies a second liquid composition, which contains the first liquid or the second liquid and a coloring material, onto the ink receiving medium, and forms the first image as a mixture of the first liquid composition and the second liquid composition. In this embodiment, the second liquid composition is an ink containing a coloring material, and the device applying the second liquid composition onto the ink receiving medium is an ink jet recording device. In addition, the first liquid composition contains a component that acts chemically or physically on the second liquid composition and further viscously thickens the mixture of the first liquid composition and the second liquid composition as compared to each of the first liquid composition and the second liquid composition. At least one of the first liquid composition and the second liquid composition contains the first liquid. Herein, the first liquid contains a liquid having low volatility at normal temperature (room temperature) and particularly contains water. The second liquid is a liquid other than the first liquid, and although the degree of volatility is not limited, is preferably a liquid having higher volatility than the first liquid. Hereinafter, the first liquid composition is referred to as the "reaction liquid", and the device applying the first liquid composition onto the ink receiving medium is referred to as the "reaction liquid applying device". In addition, the second liquid composition is referred to as the "ink", and the device applying the second liquid composition onto the ink receiving medium is referred to as the "ink applying device". Further, the first image refers to an ink image before liquid removal before the image is subjected to liquid absorbing treatment by the liquid absorbing member. An ink image after liquid removal in which the content of the first liquid is decreased by performing the liquid absorbing treatment is referred to as a second image.

<Reaction Liquid Applying Device>

The reaction liquid applying device may be any device which can apply the reaction liquid onto the ink receiving medium, and various devices conventionally known can be suitably used. Specific examples thereof include a gravure offset roller, an ink jet head, a die coating device (die coater), and a blade coating device (blade coater). The reaction liquid applied by the reaction liquid applying device may be applied before the ink is applied or after the ink is applied as long as it can be mixed (reacted) with the ink on the ink receiving medium. Preferably, the reaction liquid is applied before the ink is applied. By applying the reaction liquid before the ink is applied, it is possible to suppress bleeding in which adjacent applied inks are mixed with each other or beading in which the ink landed first is attracted to the ink landed later, at the time of ink jet type image recording.

<Reaction Liquid>

The reaction liquid contains a component increasing the viscosity of the ink (ink-viscosity-increasing component). Herein, an increase in viscosity of the ink indicates that a coloring material, a resin, and the like serving as components constituting the ink chemically react or are physically adsorbed by contact with the ink-viscosity-increasing component so that an increase in ink viscosity is recognized. This increase in viscosity of the ink includes not only a case where an increase in ink viscosity is recognized but also a case where a part of components constituting the ink such as a coloring material and a resin is aggregated to cause a local increase in viscosity. As a method of aggregating a part of components constituting the ink, a reaction liquid lowering dispersion stability of a pigment in an aqueous ink can be used. This ink-viscosity-increasing component has an effect of lowering fluidity of the ink and/or a part of components constituting the ink on the ink receiving medium and suppressing bleeding or beading at the time of forming the first image. Increasing the viscosity of the ink is also referred to as "viscously thickening the ink". As such an ink-viscosity-increasing component, known components such as polyvalent metal ion, organic acid, a cationic polymer, and porous fine particles can be used.

Of them, particularly, polyvalent metal ion and organic acid are preferable. In addition, it is also preferable that a plurality of types of the ink-viscosity-increasing component are contained. Incidentally, the content of the ink-viscosity-increasing component in the reaction liquid is preferably 5 mass % or more with respect to the total mass of the reaction liquid.

Examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$.

In addition, examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumarin acid, thiophene carboxylic acid, nicotinic acid, oxysuccinic acid, and dioxysuccinic acid.

The reaction liquid can contain an appropriate amount of water or a low-volatile organic solvent as the first liquid. Water used in this case is preferably water deionized by ion exchange or the like. In addition, an organic solvent which can be used in the reaction liquid is not particularly limited, and a known organic solvent can be used.

Further, the reaction liquid can be used by adding a surfactant or a viscosity adjuster to appropriately adjust a front surface tension or viscosity thereof. A material to be used is not particularly limited as long as it can co-exist with the ink-viscosity-increasing component. Specific examples of the surfactant to be used include an acetylene glycol ethylene oxide adduct (trade name: "ACETYLENOL E100" manufactured by Kawaken Fine Chemicals Co., Ltd.) and a perfluoroalkyl ethylene oxide adduct (trade name: "MEGAFAC F444" manufactured by DIC Corporation).

<Ink Applying Device>

An ink jet head is used as the ink applying device applying the ink. For example, an ink jet head in which film boiling occurs in an ink by an electro-thermal converter to form air bubbles so that the ink is ejected, an ink jet head in which an ink is ejected by an electro-mechanical converter, an ink jet head in which an ink is ejected by using static electricity, and the like are exemplified as the ink jet head. In the present invention, a known ink jet head can be used. Of them, particularly, from the viewpoint of printing at a high speed and a high density, the ink jet head using the electro-thermal converter is preferably used. In drawing, an image signal is received, and a necessary ink amount is applied to each position.

An amount of ink applied can be expressed by an image density (duty) or an ink thickness, and in this embodiment, an average value obtained by multiplying the mass of each of the ink dots and the number of applications together and by dividing the multiply result by a printing area is set as the amount of ink applied ($g/m^2$). Incidentally, a maximum amount of ink applied in an image region indicates an amount of ink applied which is applied in an area of at least 5 $mm^2$ or more, in a region used as information of the ink receiving medium, from the viewpoint of removing the liquid component in the ink.

The ink jet recording apparatus of the present invention may include a plurality of ink jet heads in order to apply an ink of each color onto the ink receiving medium. For example, in a case where each color image is formed by using a yellow ink, a magenta ink, a cyan ink, and a black ink, the ink jet recording apparatus includes four ink jet heads respectively ejecting four types of inks described above onto the ink receiving medium.

In addition, the ink applying device may include an ink jet head that ejects an ink containing no coloring material (clear ink).

<Ink>

Each component of the ink which is applied to the present invention will be described.

(Coloring Material)

A pigment or a dye and a mixture of a dye and a pigment can be used as the coloring material which is contained in the ink applied to the present invention. The type of pigment which can be used as the coloring material is not particularly limited. Specific examples of the pigment may include inorganic pigments such as carbon black; and organic pigments such as azo-based, phthalocyanine-based, quinacridone-based, isoindolinone-based, imidazolone-based, diketopyrrolopyrrole-based, and dioxazine-based pigments. One or two or more kinds of these pigments can be used as necessary.

The type of the dye which can be used as the coloring material is not particularly limited. Specific examples of the dye may include a direct dye, an acidic dye, a basic dye, a dispersive dye, and a food dye, and a dye having an anionic group can be used. Specific examples of a dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5 mass % or more and 15.0 mass % or less, and more preferably 1.0 mass % or more and 10.0 mass % or less with respect to the total mass of the ink.

(Dispersant)

As a dispersant dispersing a pigment, a known dispersant used in an ink jet ink can be used. In particular, a water-soluble dispersant having both a hydrophilic moiety and a hydrophobic moiety in the structure is preferably used in the embodiment of the present invention. Particularly, a pigment dispersant, which is formed by a resin containing at least a hydrophilic monomer and a hydrophobic monomer and subjected to copolymerization, is preferably used. Each monomer used herein is not particularly limited, and known monomers are preferably used. Specific examples of the hydrophobic monomer include styrene and other styrene derivatives, alkyl (meth)acrylate, and benzyl (meth)acrylate. In addition, examples of the hydrophilic monomer include acrylic acid, methacrylic acid, and maleic acid.

An acid value of the dispersant is preferably 50 mgKOH/g or more and 550 mgKOH/g or less. In addition, a weight average molecular weight of the dispersant is preferably 1000 or more and 50000 or less. Incidentally, a mass ratio of the pigment and the dispersant (pigment:dispersant) is preferably in a range of 1:0.1 to 1:3.

Further, without use of the dispersant, it is also preferable to use a so-called self-dispersible pigment which is capable of performing front surface modification to the pigment and of dispersing the pigment itself.

(Resin Fine Particles)

The ink which is applied to the present invention can be used by containing various fine particles having no coloring material. In particular, resin fine particles are preferable since the resin fine particles have an effect on improvement in image quality or fixing properties in some cases.

A material of the resin fine particles which can be used in the present invention is not particularly limited, and a known resin can be appropriately used. Specific examples thereof include homopolymers such as polyolefin, polystyrene, polyurethane, polyester, polyether, polyurea, polyamide, polyvinyl alcohol, poly(meth)acrylate and a salt thereof, alkyl poly(meth)acrylate, and polydiene, and copolymers obtained by combining and polymerizing a plurality of monomers for generating these homopolymers. A weight average molecular weight (Mw) of the resin is preferably in a range of 1,000 or more and 2,000,000 or less. In addition, the amount of the resin fine particles in the ink is preferably 1 mass % or more and 50 mass % or less and more preferably 2 mass % or more and 40 mass % or less with respect to the total mass of the ink.

Further, in the embodiment of the present invention, it is preferable to use the resin fine particles as a resin fine particle dispersion in which the resin fine particles are dispersed in the liquid. A dispersing method is not particularly limited, but a so-called self-dispersible resin fine particle dispersion in which the resin fine particles are dispersed using a resin obtained by homopolymerization of a monomer having a dissociable group or copolymerization of a plurality of monomers is preferable. Herein, examples of the dissociable group include carboxyl group, sulfonic group, and phosphoric group, and examples of a monomer having this dissociable group include acrylic acid and methacrylic acid. Similarly, a so-called emulsifying dispersing type resin fine particle dispersion in which the resin fine particles are dispersed using an emulsifier is also preferably used in the present invention. As the emulsifier described herein, regardless of low molecular weight or high molecular weight, a known surfactant is preferable. The surfactant is preferably a non-ionic surfactant or a surfactant having the same electric charge as that of the resin fine particles.

The resin fine particle dispersion used in the embodiment of the present invention preferably has a dispersed particle size of 10 nm or more and 1000 nm or less, more preferably has a dispersed particle size of 50 nm or more and 500 nm or less, and further preferably has a dispersed particle size of 100 nm or more and 500 nm or less.

Further, it is also preferable that various additives are added for stabilization when the resin fine particle dispersion used in the embodiment of the present invention is prepared. Examples of the additive include n-hexadecane, dodecyl methacrylate, stearyl methacrylate, chlorobenzene, dodecylmercaptan, blue dye (blueing agent), and polymethylmethacrylate.

(Curable Component)

In the present invention, either the reaction liquid or the ink preferably contains a component which is cured by active energy rays. By curing the component which is cured by active energy rays before a liquid absorbing step, attachment of the coloring material to the liquid absorbing member may be suppressed.

As the component, which is cured by irradiation with active energy rays, used in the present invention, a component, which is cured by irradiation with active energy rays and becomes more insoluble than before irradiation, is used. For example, a general ultraviolet curable resin can be used. Most of ultraviolet curable resins are not soluble in water, but as a material which can be adapted in an aqueous ink preferably used in the present invention, the ultraviolet curable resin preferably has at least an ethylenically unsaturated bond, which is curable by ultraviolet rays, in the structure thereof and has a hydrophilic linking group. Examples of the linking group for having hydrophilicity include a hydroxyl group, a carboxyl group, a phosphoric group, a sulfonic group and a salt thereof, an ether bond, and an amide bond.

In addition, the curable component used in the present invention is preferably a hydrophilic component. Further, examples of the active energy rays include ultraviolet rays, infrared rays, and electron beams.

Moreover, in the present invention, either the reaction liquid or the ink preferably contains a polymerization initiator. As the polymerization initiator used in the present invention, any polymerization initiator may be used as long as it is a compound generating radicals by active energy rays.

Furthermore, the case of concurrently using a sensitizer having a role of widening an absorption wavelength of light in order to improve reaction speed is one of preferred embodiments.

(Surfactant)

The ink which can be used in the present invention may contain a surfactant. Specific examples of the surfactant include an acetylene glycol ethylene oxide adduct (ACETYLENOL E100, manufactured by Kawaken Fine Chemicals Co., Ltd.). The amount of the surfactant in the ink is preferably 0.01 mass % or more and 5.0 mass % or less with respect to the total mass of the ink.

(Water and Water-Soluble Organic Solvent)

The ink used in the present invention can contain water and/or a water-soluble organic solvent as a solvent. Water is preferably water deionized by ion exchange or the like. In addition, the content of the water in the ink is preferably 30 mass % or more and 97 mass % or less and more preferably 50 mass % or more and 95 mass % or less with respect to the total mass of the ink.

Further, the type of the water-soluble organic solvent is not particularly limited, and any known organic solvents can be used. Specific examples thereof include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. As a matter of course, a mixture obtained by mixing two or more kinds selected from these can be used.

Further, the content of the water-soluble organic solvent in the ink is preferably 3 mass % or more and 70 mass % or less with respect to the total mass of the ink.

(Other Additives)

The ink which can be used in the present invention may contain various additives such as a pH adjuster, an antirust agent, an antiseptic agent, a mildewproofing agent, an antioxidant, a reduction inhibitor, a water-soluble resin and a neutralizer thereof, and viscosity adjuster, as necessary, in addition to the components described above.

<Liquid Absorbing Member>

In the present invention, at least a part of the first liquid is absorbed from the first image by being brought into contact with the liquid absorbing member having the porous body, and the content of the liquid component in the first image is reduced. A contact surface of the liquid absorbing member with the first image is set to a first surface and the porous body is disposed on the first surface. The liquid absorbing member is a member that is movable in conjunction with movement of the ink receiving medium and capable of repeatedly performing liquid collecting by the liquid collecting device and coming in contact with the first image on the ink receiving medium.

(Porous Body)

In the porous body of the liquid absorbing member according to the present invention, it is preferable that an average pore size on the first surface side is smaller than an average pore size on a second surface side opposite to the first surface. In order to prevent a coloring material of ink from being attached to the porous body, the pore size is preferably small, and the average pore size of the porous body at least on the first surface side is preferably 10 μm or less. Incidentally, the average pore size in the present invention indicates an average diameter on a front surface of the first surface or the second surface, and for example, can be measured by a known means such as a mercury intrusion method, a nitrogen adsorption method, or SEM image observation.

Further, it is preferable that the thickness of the porous body is thin in order to uniformly have high air permeability. The air permeability can be represented by a Gurley value defined in JIS P8117, and the Gurley value is preferably 10 seconds or shorter.

Here, in a case where the porous body becomes thin, there is a case where it is not possible to sufficiently ensure capacity necessary for absorbing the liquid component, and thus it is possible to form the porous body with a multi-layered configuration. In addition, in the liquid absorbing member, a layer contacting the first image may be the porous body, and a layer not contacting the first image may not be the porous body.

Next, an embodiment in a case where the porous body has a multi-layered configuration will be described. Herein, a layer on a side contacting the first image will be described as a first layer and a layer laminated on a surface opposite to a contact surface of the first layer with the first image will be described as a second layer. Further, the multi-layered configuration will be sequentially described in a lamination order from the first layer. Incidentally, in the present specification, the first layer is referred to as an "absorbing layer" and the second layer and the subsequent layers are referred to as a "support layer".

[First Layer]

In the present invention, a material of the first layer is not particularly limited, and any of a hydrophilic material having a contact angle with water of less than 90° and a water-repellent material having a contact angle with water of 90° or more can be used.

The hydrophilic material is preferably selected from a single material such as cellulose or polyacryl amide, or a composite material thereof, and the like. In addition, the water-repellent material described below can be used by performing hydrophilic treatment to a front surface of the water-repellent material. Examples of the hydrophilic treatment include methods such as a sputter etching method, radioactive ray or $H_2O$ ion irradiation, and excimer (ultraviolet ray) laser light irradiation. In the case of a hydrophilic material, the contact angle with water is preferably 60° or less. In a case where the first layer is configured by a hydrophilic material, there is an effect of suctioning up an aqueous liquid component, particularly, water by capillary force.

Meanwhile, in order to suppress the attachment of the coloring material and to increase cleaning properties, a material of the first layer is preferably a water-repellent material having low surface free energy, and particularly, a fluorine resin. Specific examples of the fluorine resin include polytetrafluoroethylene (hereinafter, PTFE), polychlorotrifluoroethylene (PCTFE), polyvinylidene fluoride (PVDF), polyvinyl fluoride (PVF), perfluoroalkoxy fluorine resin (PFA), an ethylene tetrafluoride-propylene hexafluoride copolymer (FEP), an ethylene-ethylene tetrafluoride copolymer (ETFE), and an ethylene-chlorotrifluoroethylene copolymer (ECTFE). One or two or more of resins can be used as necessary, and a plurality of films may be laminated in the first layer.

In a case where the first layer is configured by the water-repellent material, there is almost no effect of suctioning up an aqueous liquid component containing water by capillary force, and it takes time to suction up the aqueous liquid component at the time of initially being in contact with the image. For this reason, it is preferable that a liquid having a contact angle with first layer of less than 90° is immersed in the first layer. The liquid immersed in the first layer is referred to as "third liquid", "preliminary penetrant", "wetting liquid", or the like with respect to the first liquid and arbitrary second liquid in the first image in some cases. The third liquid can be immersed in the first layer by applying the third liquid from the first surface of the liquid absorbing member. It is preferable that third liquid is prepared by mixing a surfactant or a liquid having a small contact angle with the first layer into the first liquid (water).

In the present invention, the thickness of the first layer is preferably 50 μm or less. The thickness thereof is more preferably 30 μm or less. In Examples of the present invention, the thickness is obtained by measuring thicknesses of arbitrary ten points with a direct advance type micrometer OMV_25 (manufactured by Mitutoyo Corporation) and by calculating an average value thereof.

The first layer can be produced by a known method for producing a thin porous body. For example, a resin material can be molded into a sheet-shaped material by a method such as extrusion molding, and then, can be stretched to a predetermined thickness. In addition, a plasticizer such as paraffin is added to a material at the time of the extrusion molding, the plasticizer is removed by heating or the like at the time of the stretching, and thus the porous body can be obtained. A pore size can be adjusted by suitably adjusting an added amount, a draw ratio, or the like of the plasticizer to be added.

[Second Layer]

In the present invention, the second layer is preferably a layer having air permeability. Such a layer may be non-woven fabric of resin fibers or may be woven fabric. A material of the second layer is not particularly limited, but a material of which a contact angle with first liquid is identical or less than that of the first layer such that the liquid absorbed on the first layer side does not flow back, is preferable. Specifically, the material is preferably selected from a single material such as polyolefin (such as polyethylene (PE) or polypropylene (PP)), polyurethane, polyamide such as nylon, and polyester (such as polyethylene terephthalate (PET)), polysulfone (PSF) or a composite material thereof, and the like.

Further, the second layer is preferably a layer having a pore size larger than that of the first layer.

[Third Layer]

In the present invention, the multi-layered-structure porous body may have a configuration of three or more layers. Non-woven fabric is preferable as the third layer and the subsequent layers from the viewpoint of rigidity. The same material as that of the second layer is used as a material of the third layer.

[Other Materials]

The liquid absorbing member may include a reinforcement member reinforcing a side surface of the liquid absorbing member, in addition to the porous body of the laminated structure described above. In addition, the liquid absorbing member may include a joining member at the time of linking end portions of the elongated sheet-shaped porous body in a longitudinal direction with each other to be a belt-like member. A non-porous tape material or the like can be used as such a member and the member may be disposed at a position or at a cycle where the member is not contacting the image.

[Method for Producing Porous Body]

The method for forming a porous body by laminating the first layer and the second layer is not particularly limited. The first layer and the second layer may overlap with each other, or the first layer and the second layer may adhere to each other by using a method such as lamination by adhesive agent or lamination by heating. From the viewpoint of the air permeability, lamination by heating is preferable in the present invention. In addition, for example, a part of the first layer or the second layer may be melted by heating so that the first layer and the second layer may adhere to each other. In addition, a fusion material such as hot melt powder is interposed between the first layer and the second layer, and the first layer and the second layer may adhere to each other by heating. In a case where the third layer and the subsequent layers are laminated, the layers may be laminated at one time, or may be sequentially laminated. A lamination order is suitably selected.

In the heating step, a lamination method in which a porous body is heated while the porous body is interposed and pressurized by heated rollers is preferable.

(Liquid Absorbing by Liquid Absorbing Member and Liquid Collecting)

The liquid component absorbed in the porous body of the liquid absorbing member from the first image is collected by the liquid storage member by applying pressurized gas to the second surface opposite to the first surface at the side, which comes in contact with (is contacting) the first image, of the porous body and extruding the liquid from the second surface.

Figure 6A:
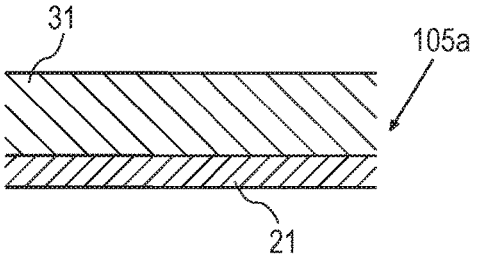
FIG. 6A is a schematic cross-sectional view of a liquid collecting mechanism in the present invention.
Figure 6B:
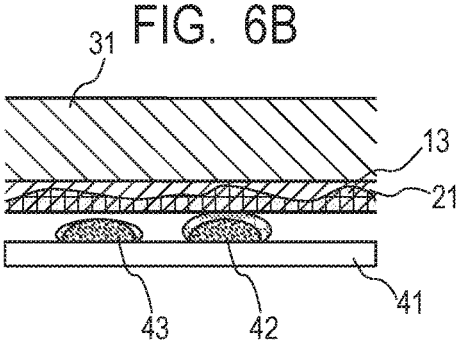
FIG. 6B is a schematic cross-sectional view of the liquid collecting mechanism in the present invention.
Figure 6C:
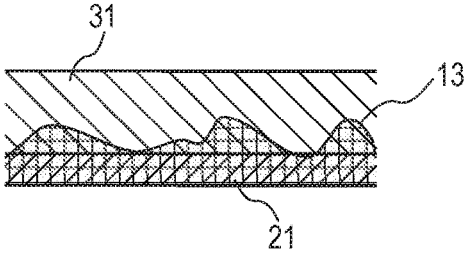
FIG. 6C is a schematic cross-sectional view of the liquid collecting mechanism in the present invention.
Figure 6D:
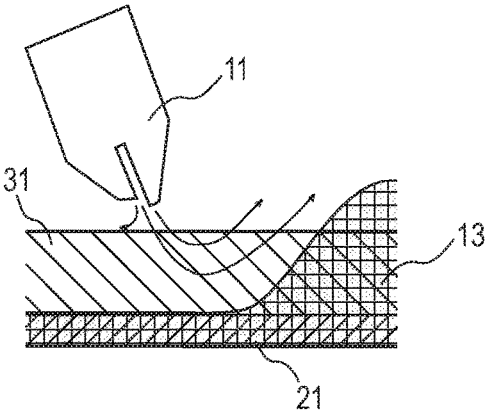
FIG. 6D is a schematic cross-sectional view of the liquid collecting mechanism in the present invention.
Figure 6E:
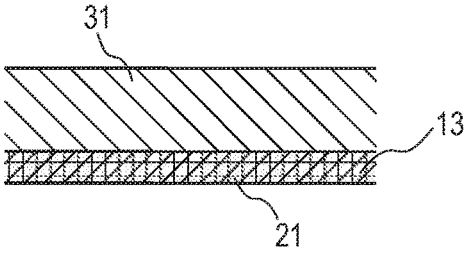
FIG. 6E is a schematic cross-sectional view of the liquid collecting mechanism in the present invention.
Figure 7:
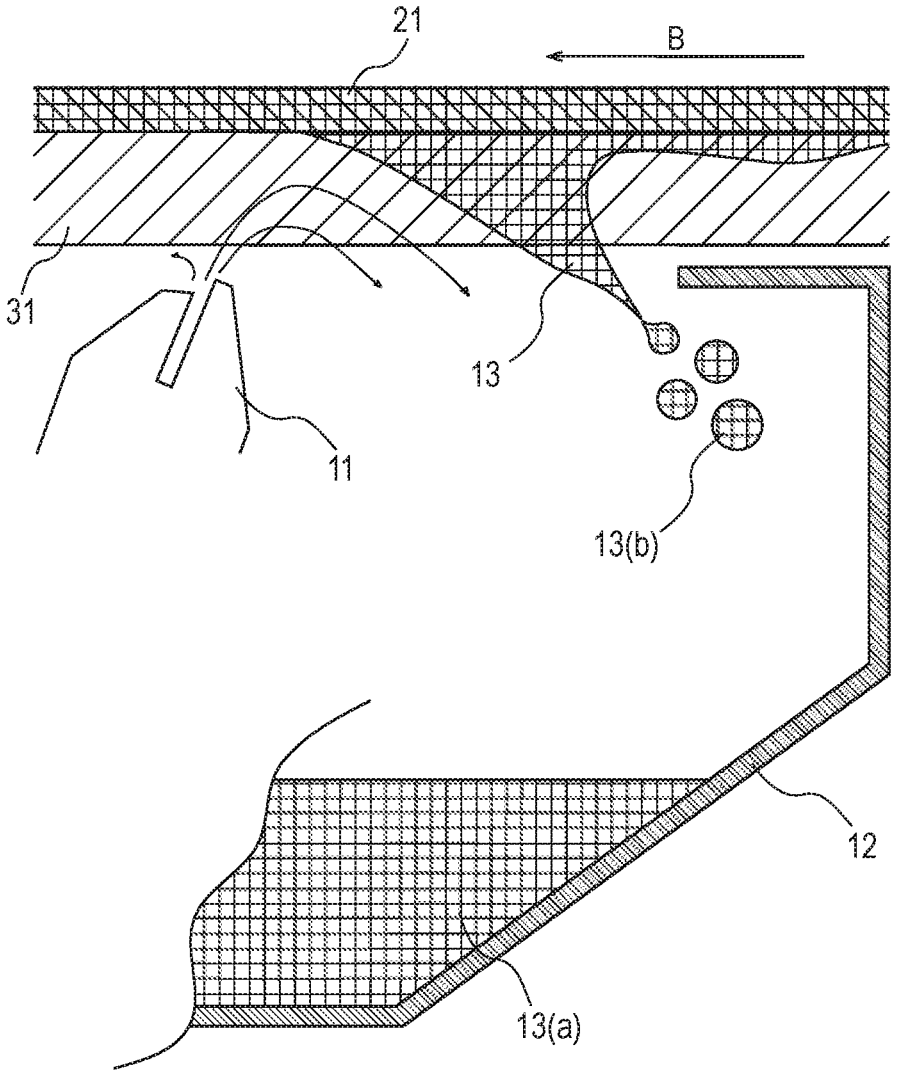
FIG. 7 is a schematic cross-sectional view describing a preferred embodiment in the liquid collecting mechanism.

In FIGS. 6A to 6E, liquid absorbing and liquid collecting mechanisms using a liquid absorbing member 105*a* having a porous body with a two-layered configuration of the absorbing layer 21 and the support layer 31 will be described. In FIG. 6A, an outer surface of the absorbing layer 21 becomes the first surface which comes in contact with the first image and an outer surface of the support layer 31 becomes the second surface. Next, as illustrated in FIG. 6B, when a first image 42 formed on an ink receiving medium 41 and the first surface of the liquid absorbing member 105*a* are in contact with each other, a liquid 13 containing a first liquid in the first image 42 is absorbed in the absorbing layer 21. A second image 43 is an image (ink image) after the liquid is absorbed and removed from the first image. Herein, absorbing and removing of the liquid from the first image means that all of the liquid components in the first image are not necessarily absorbed and removed and it is sufficient that the liquid content, which becomes excessive due to aggregation of solid content of a coloring material or the like, is absorbed and removed. Incidentally, an image state that solid and liquid seem to be separated is illustrated in the drawings for descriptive purposes, but the image state is not limited thereto. By repeating such liquid absorbing, as illustrated in FIG. 6C, the liquid 13 absorbed in the absorbing layer 21 osmoses up to the support layer 31. When the pressurized gas is ejected from the support layer 31 side (second surface) in a state where the liquid 13 osmoses up to the support layer 31 in this way, the liquid is swept in the coarse support layer 31 and is extruded from the second surface (FIG. 6D). Herein, the pressurized gas is linearly ejected from the air knife 11 as the gas ejection member (pressurized gas ejection member). At this time, as illustrated in FIG. 7, the pressurized gas is applied from the lower side in the gravitational direction to the second surface of the support layer 31 disposed at the upper side in the gravitational direction. By doing this, the liquid 13 extruded from the second surface is dropped as liquid droplets 13(*b*) by action of the pressurized gas and the force of gravity and is collected as a collected liquid 13(*a*) in the liquid collecting chamber 12 that is the liquid storage member. According to this arrangement, reattachment of liquid droplets to the liquid absorbing member can be prevented. In the fine absorbing layer 21, the liquid is less likely to be extruded by the pressurized gas, and the liquid 13 remains (FIG. 6E). Even when the liquid 13 remains in the fine absorbing layer 21, by pressing the liquid absorbing member 105*a* against the first image using a predetermined nip pressure and pressurizing and osmosing the liquid, as described later, there is no influence on the next liquid absorbing process. In addition, in a case where the absorbing layer 21 is a water-repellent material, when remaining liquid exists, it is not necessary to apply preliminary penetrant again.

The liquid collecting device includes the pressurized gas ejection member and the liquid storage member as described above.

(Gas Ejection Member)

The gas ejection member is not particularly limited as long as it can eject gas to the second surface of the liquid absorbing member 105*a*, but a member, which blows air pressurized (pressurized gas) at a predetermined air speed or air flow rate, such as an air nozzle or an air knife is preferable. In particular, one which linearly ejects pressurized gas from a tip slit like an air knife is more preferable.

As a gas ejection direction, in order to easily extrude the liquid 13 in the support layer 31, as illustrated in FIG. 7, it is preferable to eject gas such that the gas is extruded in a direction opposite to a conveyance direction B of the liquid absorbing member. Particularly, in a case where the conveyance speed of the liquid absorbing member is rapid, the sweeping effect by gas is not sufficiently obtained in the same direction as the conveyance direction B (forward direction) and the liquid 13 in the support layer 31 cannot be extruded in some cases. Therefore, the ejection direction of the gas ejected from the gas ejection member is preferably a direction inclined to the direction opposite to the movement direction of the liquid absorbing member from the vertical direction with respect to the second surface. The inclination of the ejection direction from the vertical direction with respect to the second surface varies depending on the conveyance speed of the liquid absorbing member and the pressure of the gas ejected, but in a case where the vertical direction is regarded as 0° and the direction opposite to the movement direction of the liquid absorbing member is regarded to be positive, by setting the inclination in a range of −5° to 30°, the sweeping effect is obtained. Particularly, the inclination is preferably set to be larger than 0°.

As a gas ejection port of the gas ejection member is separated away from the second surface of the porous body, the gas applied to the second surface is dispersed and the sweeping effect is also degraded. For this reason, although depending on the air speed or the air flow rate from the ejection port, the ejection port is preferably disposed at a distance of 5 mm or less from the second surface of the porous body.

The air speed or the air flow rate from the ejection port are adjusted by appropriately adjusting an introduction pressure of the gas into the gas ejection member such as an air knife and the size of the ejection port (the slit width in the case of the air knife) such that a desired sweeping effect is achieved.

(Liquid Storage Member)

The liquid storage member may have any configuration as long as it can prevent the liquid extruded from the second surface of the porous body from being reattached to the second surface and can store the liquid. In addition, the liquid storage member may be a member having a mechanism discharging the stored liquid to the outside or a member which is configured to be attachably detached from the liquid absorbing device and can be exchanged along with the stored liquid. For example, a chamber which has an opening toward the second surface of the porous body and can store the collected liquid 13(*a*) dropped as the liquid droplets 13(*b*), an absorber which can absorb the extruded liquid by the absorber coming in contact with the second surface of the porous body, and the like are exemplified.

Next, a specific embodiment example of the ink jet recording apparatus of the present invention will be described.

As the ink jet recording apparatus of the present invention, an ink jet recording apparatus in which a first image is formed on a transfer body as an ink receiving medium and a second image after a first liquid is absorbed by a liquid absorbing member is transferred to a recording medium and an ink jet recording apparatus in which a first image is formed on a recording medium as an ink receiving medium are exemplified. Incidentally, in the present invention, the former ink jet recording apparatus is hereinafter referred to as a transfer type ink jet recording apparatus for descriptive purposes and the latter ink jet recording apparatus is hereinafter referred to as a direct drawing type ink jet recording apparatus for descriptive purposes.

Hereinafter, each of the ink jet recording apparatuses will be described.

[Transfer Type Ink Jet Recording Apparatus]

Figure 1B:
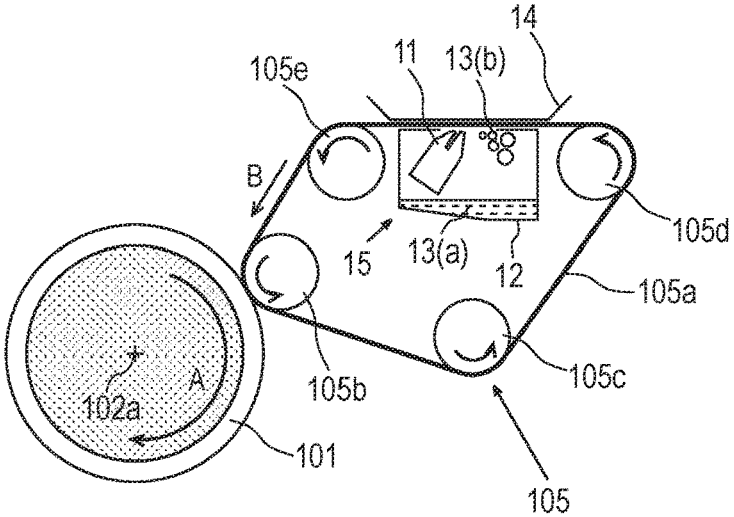
FIG. 1B is a schematic diagram illustrating an example of the configuration of the transfer type ink jet recording apparatus according to the embodiment of the present invention.

FIGS. 1A and 1B are schematic diagrams illustrating an example of the schematic configuration of a transfer type ink jet recording apparatus in this embodiment. A transfer type ink jet recording apparatus 100 includes a transfer body 101 that temporarily holds a first image and a second image in which a part of a first liquid is absorbed and removed from the first image. In addition, the transfer type ink jet recording apparatus 100 includes a pressing member 106 that transfers the second image onto a recording medium, such as paper, on which the second image is to be formed.

The transfer type ink jet recording apparatus 100 of the present invention includes the transfer body 101 supported by a support member 102, a reaction liquid applying device 103 applying a reaction liquid onto the transfer body 101, an ink applying device 104 applying an ink onto the transfer body 101 applied with the reaction liquid to form an image on the transfer body, a liquid absorbing device 105 absorbing a liquid component from the image on the transfer body, and the pressing member 106 for transferring, by pressing a recording medium 108, the image on the transfer body, from which the liquid component is removed, onto the recording medium 108, such as paper. In addition, the transfer type ink jet recording apparatus 100 may include a transfer body cleaning member 109 cleaning a front surface of the transfer body 101 after a second image is transferred to the recording medium 108.

The support member 102 rotates around a rotation axis 102*a* in a direction of an arrow A of FIGS. 1A and 1B. According to the rotation of the support member 102, the transfer body 101 is moved. The reaction liquid of the reaction liquid applying device 103 and the ink of the ink applying device 104 are sequentially applied onto the moving transfer body 101 to form a first image on the transfer body 101. The first image formed on the transfer body 101 is moved to a position contacting a liquid absorbing member 105*a* of the liquid absorbing device 105 according to movement of the transfer body 101.

The liquid absorbing member 105*a* of the liquid absorbing device 105 is moved in synchronization with the rotation of the transfer body 101. The first image formed on the transfer body 101 undergoes a state of being in contact with the moving liquid absorbing member 105*a*. In this period, the liquid absorbing member 105*a* removes the liquid component from the first image. When the first image undergoes a state of being in contact with the moving liquid absorbing member 105*a*, the liquid component contained in the first image is removed. In this contact state, it is preferable that the liquid absorbing member 105*a* is pressed against the first image with a predetermined pressing force from the viewpoint of allowing the liquid absorbing member 105*a* to effectively function.

The removal of the liquid component can be expressed from a different point of view as condensing the ink constituting the first image formed on the transfer body. Condensing the ink means that the proportion of the solid content contained in the ink, such as coloring material and resin, with respect to the liquid component contained in the ink increases owing to reduction in the liquid component.

Then, the second image after the liquid component is removed is moved to a transfer unit contacting the recording medium 108, which is conveyed by a recording medium conveying device 107, according to movement of the transfer body 101. While the second image after the liquid component is removed is in contact with the recording medium 108, the pressing member 106 presses the recording medium 108 to transfer the image (ink image) onto the recording medium 108. The ink image after the transfer, which is transferred onto the recording medium 108, is a reverse image of the second image. In the following description, separately from the first image (ink image before removing liquid) and the second image (ink image after removing liquid) described above, the ink image after the transfer is referred to as a third image in some cases.

Incidentally, since the first image is formed by applying the reaction liquid onto the transfer body and then applying the ink, the reaction liquid does not react with the ink and thus remains in a non-image region (non-ink-image-formation region). In this device, the liquid absorbing member 105*a* removes the liquid component not only from the first image but also removes the liquid component of the reaction liquid from the front surface of the transfer body 101 by the liquid absorbing member also coming in contact with non-reacted reaction liquid.

Therefore, hereinbefore, it is expressed that the liquid component is removed from the first image, but it is not limitedly indicated that the liquid component is removed only from the first image, and it is indicated that the liquid component is removed from the first image at least on the transfer body. For example, it is also possible to remove the liquid component in the reaction liquid applied to the first image and the outer side region of the first image.

Incidentally, the liquid component does not have a certain shape but has fluidity, and is not particularly limited as long as it has approximately a constant volume. For example, water, an organic solvent, or the like, contained in the ink or the reaction liquid is exemplified as the liquid component.

Further, also in a case where the aforementioned clear ink is contained in the first image, the ink can be condensed by liquid absorbing treatment. For example, in a case where the clear ink is applied onto the color ink containing a coloring material which is applied onto the transfer body 101, the clear ink is present entirely on the front surface of the first image or the clear ink is present partially at one part or a plurality of parts of the front surface of the first image and the color ink is present at the other parts. In the first image, the porous body absorbs the liquid component of the clear ink on the front surface of the first image at the part where the clear ink is present on the color ink, and the liquid component of the clear ink is moved. When the liquid component in the color ink is moved to the porous body side with that movement, the aqueous liquid component in the color ink is absorbed. Meanwhile, at the part where the region of the clear ink and the region of the color ink are present on the front surface of the first image, the respective liquid components of the color ink and the clear ink are moved to the porous body side, and thus the aqueous liquid component is absorbed. Incidentally, the clear ink may contain a large amount of a component for improving transferability of the image from the transfer body 101 to the recording medium. For example, a case where the content of a component exhibiting high pressure-sensitive adhesiveness to the recording medium compared to the color ink is increased by heating is exemplified.

Each configuration of the transfer type ink jet recording apparatus of this embodiment will be described below.

<Transfer Body>

The transfer body 101 includes a surface layer including an image formation surface. Various materials such as a resin and ceramic can be suitably used as a material of the surface layer, and a material having a high modulus of compressive elasticity is preferable from the viewpoint of durability or the like. Specific examples thereof include an acrylic resin, an acryl silicone resin, a fluorine-containing resin, and a condensate obtained by condensing a hydrolyzable organic silicon compound. In order to improve wettability, transferability, or the like of the reaction liquid, surface treatment may be performed. Examples of the surface treatment include frame treatment, corona treatment, plasma treatment, grinding treatment, roughening treatment, active energy ray irradiation treatment, ozone treatment, surfactant treatment, and silane coupling treatment. A plurality of such treatments may be combined. In addition, the surface layer can be in an arbitrary shape.

In addition, the transfer body preferably includes a compressive layer having a function of absorbing a pressure variation. By disposing the compressive layer, the compressive layer can absorb the deformation, disperse the variation with respect to a local pressure variation, and maintain favorable transferability even at the time of high-speed printing. For example, acrylonitrile-butadiene rubber, acryl rubber, chloroprene rubber, urethane rubber, silicone rubber, and the like are exemplified as a material of the compressive layer. When the rubber material is molded, it is preferable that a predetermined amount of a vulcanizing agent, a vulcanization accelerator, or the like is blended, and a foaming agent and a filler such as fine hollow particles or a dietary salt are further blended as necessary, and thus a porous material is formed. Accordingly, in various pressure variations, an air bubble portion is compressed along a volume change, and thus it is possible to decrease the deformation in directions other than a compression direction, and to obtain more stable transferability and durability. As the porous rubber material, there are mentioned a porous rubber material having a continuous pore structure in which pores are continuous with each other, and a porous rubber material having an independent pore structure in which pores are independent from each other. In the present invention, any one structure may be used, or the structures may be used together.

Further, the transfer body preferably has an elastic layer between the surface layer and the compressive layer. Various materials such as a resin and ceramic can be suitably used as a material of the elastic layer. Various elastomer materials and rubber materials are preferably used from the viewpoint of processing properties or the like. Specifically, for example, fluorosilicone rubber, phenyl silicone rubber, fluorine rubber, chloroprene rubber, urethane rubber, nitrile rubber, ethylene propylene rubber, natural rubber, styrene rubber, isoprene rubber, butadiene rubber, a copolymer of ethylene/propylene/butadiene, nitrile butadiene rubber, and the like are exemplified. In particular, silicone rubber, fluorosilicone rubber, and phenyl silicone rubber have small compression set, and thus are preferable from the viewpoint of dimensional stability and durability. In addition, silicone rubber, fluorosilicone rubber, and phenyl silicone rubber have a small change in a modulus of elasticity according to a temperature, and thus are also preferable from the viewpoint of transferability.

Various adhesive agent or double-faced tapes for fixing and retaining the respective layers configuring the transfer body (the surface layer, the elastic layer, and the compressive layer) may be used between the respective layers. In addition, a reinforcement layer having a high modulus of compressive elasticity may be disposed in order to suppress lateral extension or to retain an elasticity at the time of mounting the transfer body on the apparatus. In addition, woven fabric may be used as the reinforcement layer. The transfer body can be produced by arbitrarily combining the respective layers according to the material.

The size of the transfer body can be freely selected according to a desired printing image size. The shape of the transfer body is not particularly limited, and specifically, the transfer body is in the shape of a sheet, a roller, a belt, an endless web, and the like.

<Support Member>

The transfer body 101 is supported on the support member 102. Various adhesive agents or double-faced tapes may be used as a support method of the transfer body. Alternatively, an installation member formed of a metal, ceramic, a resin, or the like is attached to the transfer body, and thus the transfer body may be supported on the support member 102 by using the installation member.

The support member 102 is required to have a certain degree of structure strength from the viewpoint of conveying accuracy and durability thereof. A metal, ceramic, a resin, and the like are preferably used as a material of the support member. Among them, particularly, aluminum, iron, stainless steel, an acetal resin, an epoxy resin, polyimide, polyethylene, polyethylene terephthalate, nylon, polyurethane, silica ceramic, and alumina ceramic are preferably used as a material of the support member in order to improve control responsiveness by reducing inertia at the time of an operation in addition to rigidity capable of withstanding pressurization at the time of the transfer or a dimensional accuracy. In addition, these materials may be used in combination.

<Reaction Liquid Applying Device>

The ink jet recording apparatus of this embodiment includes the reaction liquid applying device 103 that applies reaction liquid to the transfer body 101. The reaction liquid applying device 103 of FIG. 1A is a gravure offset roller provided with a reaction liquid storage unit 103*a* storing the reaction liquid and reaction liquid applying members 103*b* and 103*c* applying the reaction liquid in the reaction liquid storage unit 103*a* onto the transfer body 101.

<Ink Applying Device>

The ink jet recording apparatus of this embodiment includes the ink applying device 104 that applies the ink to the transfer body 101 applied with the reaction liquid. By mixing the reaction liquid and the ink, the first image is formed, and then the liquid component is absorbed by the following liquid absorbing device 105 from the first image.

<Liquid Absorbing Device>

In this embodiment, the liquid absorbing device 105 includes the liquid absorbing member 105*a* and a pressing member 105*b*, for absorbing a liquid, which presses the liquid absorbing member 105*a* against the first image on the transfer body 101. The shapes of the liquid absorbing member 105*a* and the pressing member 105*b* are not particularly limited. For example, as illustrated in FIGS. 1A and 1B, a configuration may be employed in which the pressing member 105*b* has a columnar shape, the liquid absorbing member 105*a* has a belt shape, and the belt-shaped liquid absorbing member 105*a* is pressed against the transfer body 101 by the columnar-shaped pressing member 105*b*. In addition, a configuration may be employed in which the pressing member 105*b* has a columnar shape, the liquid absorbing member 105*a* has a drum shape and is formed on the periphery surface of the columnar-shaped pressing member 105*b*, and the drum-shaped liquid absorbing member 105*a* is pressed against the transfer body 101 by the columnar-shaped pressing member 105*b*. The liquid absorbing device 105 also has a mechanism that causes the drum-shaped liquid absorbing member 105*a* to be rotatable in conjunction with movement of the ink receiving medium.

In the present invention, in consideration of a space or the like in the ink jet recording apparatus, the liquid absorbing member 105*a* preferably has a belt shape. In addition, the liquid absorbing device 105 including such a belt-shaped liquid absorbing member 105*a* may include a member stretching the liquid absorbing member 105*a* and capable of conveying the belt-shaped liquid absorbing member in conjunction with movement of the ink receiving medium. As such a member, in FIGS. 1A and 1B, stretching rollers 105*c*, 105*d*, and 105*e* are used. In FIGS. 1A and 1B, the pressing member 105*b* is also a rotating roller member as with the stretching roller, but is not limited thereto.

In the liquid absorbing device 105, the liquid absorbing member 105*a* having a porous body is pressed against the first image by the pressing member 105*b* to cause the liquid component contained in the first image to be absorbed in the liquid absorbing member 105*a*, and thus the second image in which the liquid component is reduced from the first image is obtained. Various methods known from the related art, for example, a heating method, a method of blowing low-humidity air, a decompressing method, and the like may be used in combination as a method of removing the liquid component in the first image in addition to this method of pressing the liquid absorbing member.

Hereinafter, various conditions and configurations in the liquid absorbing device 105 will be described in detail.

(Pre-Treatment)

In this embodiment, it is preferable to perform pretreatment by applying a preliminary penetrant (third liquid, wetting liquid) to the liquid absorbing member 105*a* before bringing the liquid absorbing member 105*a*, which has a porous body, into contact with the first image in a case where the first surface of the porous body is a water-repellent material and the first liquid contains water.

The preliminary penetrant has a contact angle with the first surface of the porous body of less than 90° and preferably contains water and a water-soluble organic solvent. Water is preferably water deionized by ion exchange, or the like. In addition, the type of the water-soluble organic solvent is not particularly limited, and any known organic solvent such as ethanol or isopropyl alcohol can be used. In the pre-treatment of the liquid absorbing member 105*a*, an application method for the preliminary penetrant is not particularly limited, but immersion or liquid droplet dropping is preferable.

(Pressurization Condition)

It is preferable that the pressure of the liquid absorbing member at the time of pressing the liquid absorbing member against the first image on the transfer body is 2.9 N/cm$^2$ (0.3 kgf/cm$^2$) or more since it is possible to perform solid-liquid separation to the liquid in the first image in a short time and to remove the liquid component from the first image. Incidentally, the pressure of the liquid absorbing member in the present specification indicates a nip pressure between the ink receiving medium and the liquid absorbing member and is calculated by performing surface pressure measurement with a surface pressure distribution measuring device (I-SCAN manufactured by NITTA Corporation) and by dividing a weight in a pressurization region by an area.

(Duration of Activity)

A duration of activity of bringing the liquid absorbing member 105*a* into contact with the first image is preferably within 50 ms (millisecond) in order to further prevent the coloring material in the first image from being attached to the liquid absorbing member. Incidentally, the duration of activity in the present specification is calculated by dividing a pressure sensing width in the movement direction of the ink receiving medium by a movement speed of the ink receiving medium in the aforementioned surface pressure measurement. Hereinafter, the duration of activity will be referred to as liquid absorption nipping time.

<Liquid Collecting Device>

A liquid collecting module 15 is used as the liquid collecting device. The liquid collecting module 15 extrudes the liquid content osmosing inside the liquid absorbing portion 105*a* and blows off the liquid content as the liquid droplets 13(*b*) separated away from the second surface of the porous body by blowing pressurized air from the second surface (inner side) of the liquid absorbing member 105*a* by a gas ejection member (pressurized gas ejection member), such as the air knife 11, provided in the liquid collecting chamber 12. The blown-off liquid droplets 13(*b*) are stored as the collected liquid 13(*a*) in the bottom portion of the liquid collecting chamber 12. A backup roller 16 as illustrated in FIG. 1A is disposed at the first surface (front surface) of the liquid absorbing member 105*a* facing the liquid collecting module 15, swelling of the liquid absorbing member 105*a* to the outer side is suppressed by applying pressurized gas and reattachment of the blown-off liquid droplets 13(*b*) to the liquid absorbing portion 105*a* can be prevented. In addition, as illustrated in FIG. 1B, a plate-shaped support member 14 may be disposed on the first surface of the liquid absorbing member 105*a* instead of the backup roller 16. Since the support member 14 comes in contact with the first surface of the liquid absorbing member 105*a* to generate friction, a configuration using the backup roller 16 is preferable. Further, the liquid collecting device is preferably disposed at a position where the second surface (inner surface) of the liquid absorbing member 105*a* faces downward in the gravitational direction. At this time, the pressurized gas is ejected from the lower side to the upper side in the gravitational direction.

Figure 11A:
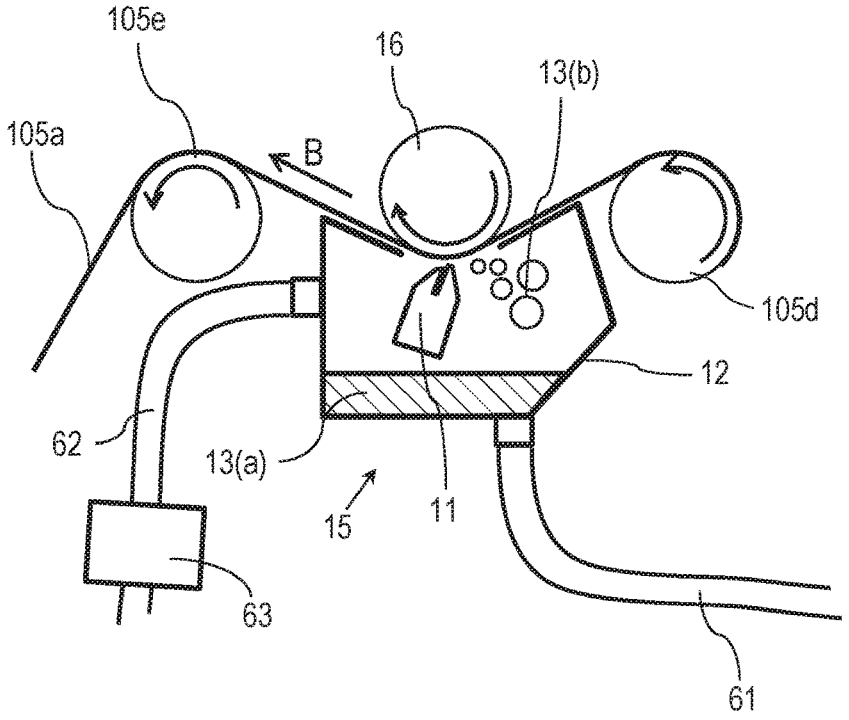
FIG. 11A is an enlarged side view of a liquid collecting device.
Figure 11B:
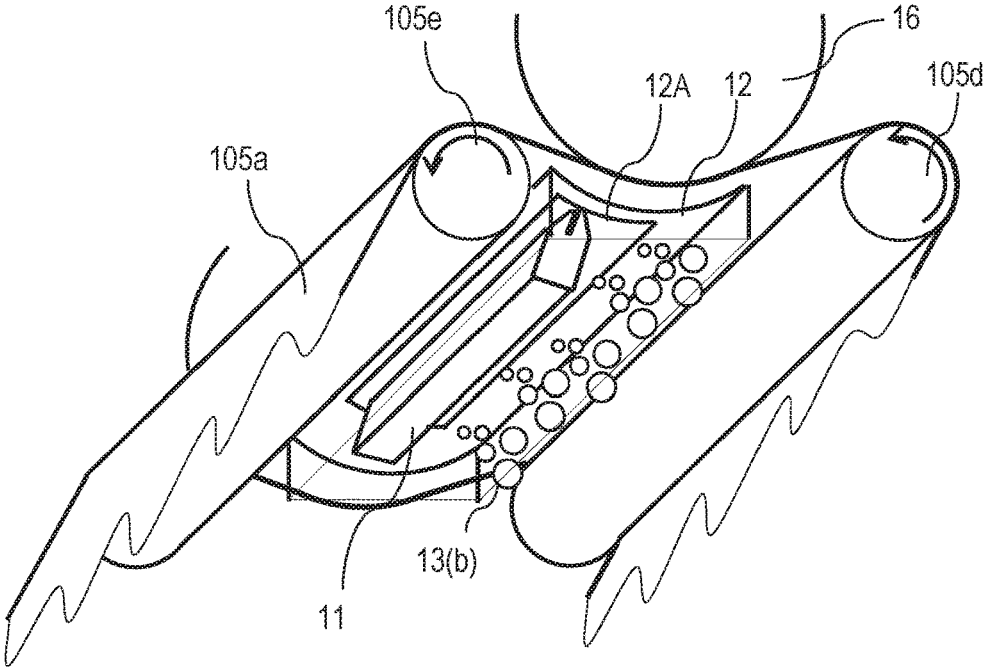
FIG. 11B is an enlarged perspective view of the liquid collecting device.

FIG. 11A is an enlarged schematic diagram of the liquid collecting device 15 in FIG. 1A. FIG. 11B is a partially perspective view from an obliquely downward direction. As illustrated in FIG. 11A, the air knife 11 is provided inside the liquid collecting chamber 12, and pressurized air is supplied by a pressurized air supply tube (not illustrated). A slit for blowing out air is provided in the air knife 11, the air blown out from this slit is blown to the second surface of the liquid absorbing member 105*a*, the liquid extruded from the liquid absorbing member 105*a* becomes the liquid droplets 13(*b*), and then the liquid droplets 13(*b*) are discharged and flown. The flown liquid droplets 13(*b*) are accommodated inside the liquid collecting chamber 12 and stored as the collected liquid 13(*a*) in the bottom portion. The stored collected liquid 13(*a*) is discharged to the outside appropriately through a drain tube 61. A drain valve (not illustrated) is attached to the tip of the drain tube 61 and is appropriately opened and closed according to the amount of the collected liquid 13(*a*) accommodated in the liquid collecting chamber 12. In addition, an exhaust tube 62 is provided in the liquid collecting chamber 12 in order to prevent a pressure in the liquid collecting chamber 12 from being increased, and gas is appropriately discharged from the exhaust tube. Herein, since some of the liquid droplets 13(*b*) are mixed in a mist state in gas to be discharged, an exhaust filter 63 for collecting the liquid droplets can be provided.

Figure 11C:
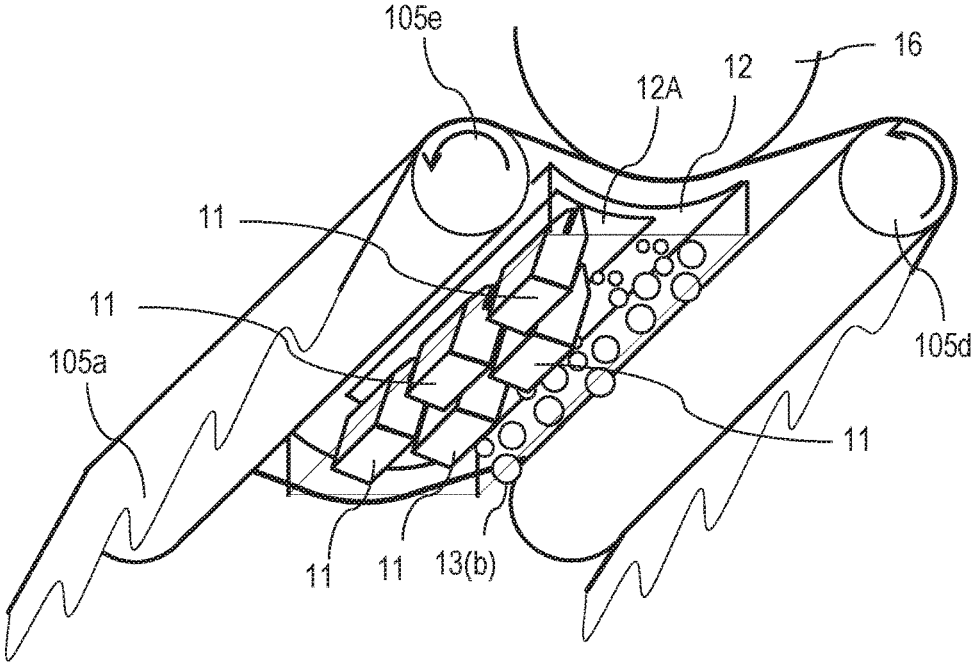
FIG. 11C is an enlarged perspective view of a modification of the liquid collecting device.
Figure 11D:
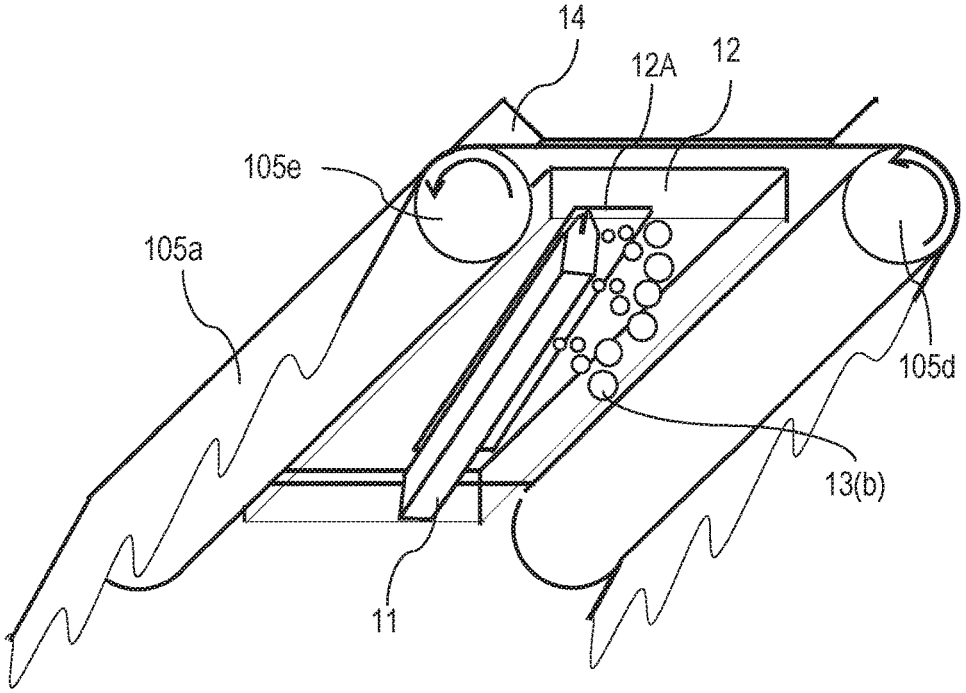
FIG. 11D is an enlarged perspective view of another modification of the liquid collecting device.

As illustrated in FIG. 11B, the upper surface of the liquid collecting chamber 12 has a curved shape along the liquid absorbing member curved by the backup roller 16, and is provided with an opening 12A for blowing air from the air knife 11 to the part. The opening 12A is opened with a width (referred to as a horizontal width) equal to or more than the width, which is contacting the transfer body 101, of the liquid absorbing member 105*a* in the width direction of the liquid absorbing member 105*a*. In addition, a width of the opening 12A in the conveyance direction of the liquid absorbing member 105*a* (referred to as a vertical width) is appropriately adjusted according to the flying direction of the liquid droplets 13(*b*). The air knife 11 is disposed to be substantially parallel to the backup roller 16. As the air knife 11, an elongated air knife having a slit in a horizontal width direction of the opening 12A may be used as illustrated in FIG. 11B, or a plurality of air knives 11 may be disposed as illustrated in FIG. 11C, such that pressurized gas can be uniformly ejected in the horizontal width direction of the opening 12A. The arrangement of the air knife 11 in FIGS. 11B and 11C can also be applied to a case where the support member 14 is used instead of the backup roller 16 as in FIGS. 1B and 2B. In addition, as illustrated in FIG. 11D, in a case where the support member 14 is used instead of the backup roller 16, the opening 12A can be slightly obliquely disposed, and the air knife 11 can also be disposed in a direction parallel to the long side of the opening 12A. By obliquely disposing the opening, an effect that the liquid is easily gathered at one side can also be expected. Also in the case of using the backup roller 16, by obliquely disposing the backup roller 16 itself with respect to the conveyance direction of the liquid absorbing member 105*a*, the air knife 11 can be disposed to be substantially parallel to the backup roller 16 and to be inclined.

Figure 12A:
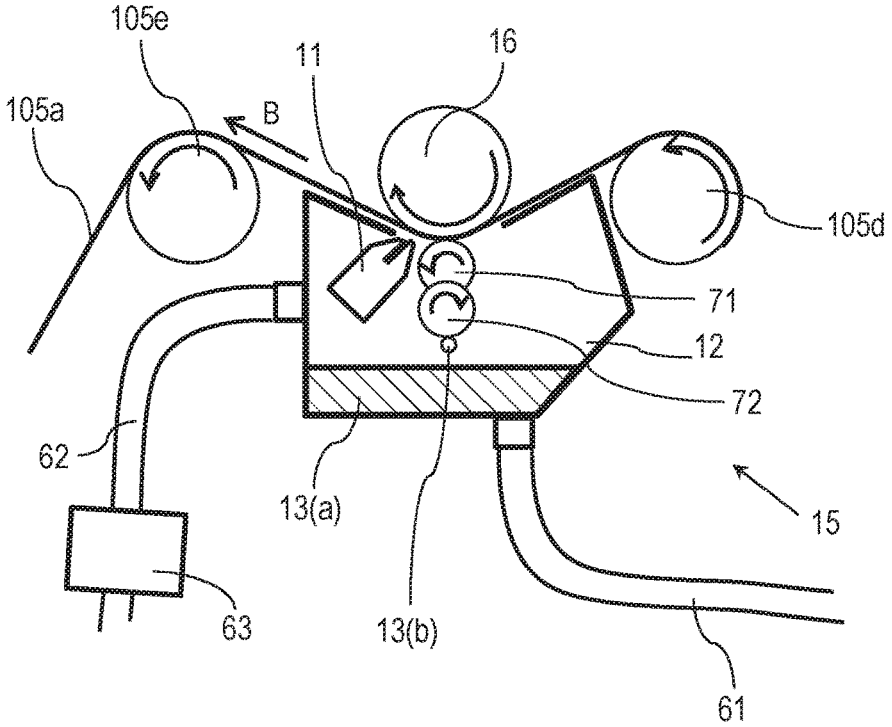
FIG. 12A is a schematic diagram of a third example.
Figure 12B:
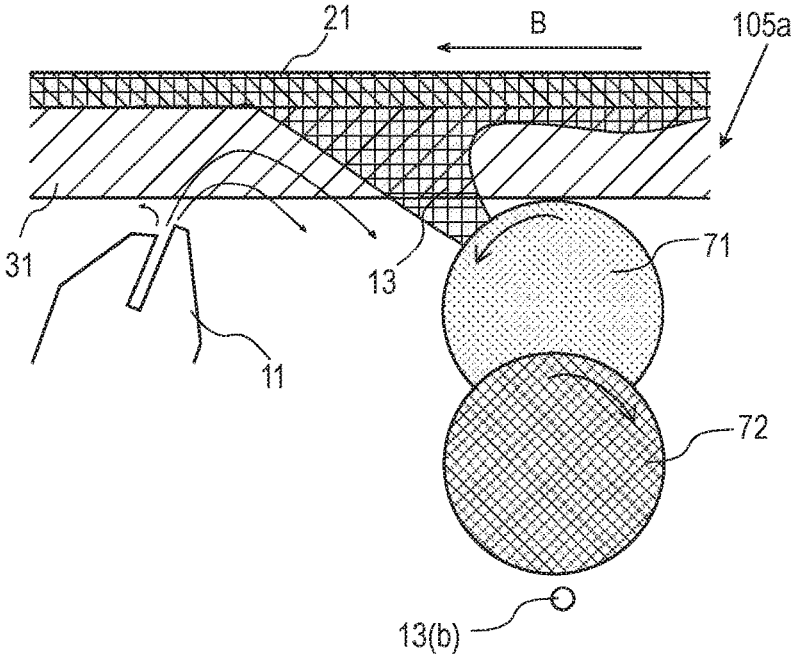
FIG. 12B is an enlarged conceptual diagram of FIG. 12A.

Further, the liquid collecting device of this embodiment can absorb the extruded liquid 13 by bringing a sponge roll 71 into contact with the second surface of the liquid absorbing member 105*a*, that is, the front surface of the support layer 31 as illustrated in FIGS. 12A and 12B, other than extruding the liquid 13 from the second surface of the liquid absorbing member 105*a* to allow the liquid to fly as the liquid droplets 13(*b*). In this example, an embodiment is illustrated in which the liquid absorbed in the sponge roll 71 is squeezed by a squeeze roll 72 to be dropped as the liquid droplets 13(*b*) and is stored as the collected liquid 13(*a*) at the bottom portion of the liquid collecting chamber 12. The other configurations are the same as in FIG. 11A.

As described above, it is preferable that the liquid storage member includes a chamber having an opening that is open to the second surface of the porous body and the pressurized gas ejection member such as the air knife 11 is included in the chamber.

In the present invention, the pressurized gas ejection member and the liquid storage member of the liquid collecting device are included in the inner side of the belt-shaped or drum-shaped liquid absorbing member.

As described above, the liquid component is absorbed on the transfer body 101 from the first image, and the second image in which the liquid content is reduced is formed. Then, the second image is transferred onto the recording medium 108 in the transfer unit. An apparatus configuration and condition at the time of the transfer will be described.

<Pressing Member for Transfer>

In this embodiment, the image (ink image) is transferred onto the recording medium 108 by the pressing member 106 pressing the recording medium 108 while the second image is in contact with the recording medium 108 conveyed by the recording medium conveying means 107. The liquid component contained in the first image on the transfer body 101 is removed and then is transferred to the recording medium 108, and thus, it is possible to obtain a recording image in which curling, cockling, or the like, is suppressed.

The pressing member 106 is required to have a certain degree of structure strength from the viewpoint of conveying accuracy or durability of the recording medium 108. A metal, ceramic, a resin, or the like is preferably used as a material of the pressing member 106. Among them, particularly, aluminum, iron, stainless steel, an acetal resin, an epoxy resin, polyimide, polyethylene, polyethylene terephthalate, nylon, polyurethane, silica ceramic, and alumina ceramic are preferably used in order to improve control responsiveness by reducing inertia at the time of an operation in addition to rigidity capable of withstanding pressurization at the time of transfer or a dimensional accuracy. In addition, these materials may be used in combination.

Pressing time for pressing the pressing member 106 against the transfer body in order to transfer the second image on the transfer body 101 to the recording medium 108 is not particularly limited, but it is preferable that the pressing time is 5 ms or more and 100 ms or less in order to favorably perform transfer, and not to impair the durability of the transfer body. Incidentally, the pressing time in this embodiment indicates time when the recording medium 108 is in contact with the transfer body 101, and is calculated by performing surface pressure measurement with a surface pressure distribution measuring device (I-SCAN manufactured by NITTA Corporation), and by dividing a length of a pressurization region in a conveying direction by a conveyance speed.

In addition, a pressure of pressing the pressing member 106 against the transfer body in order to transfer the image on the transfer body 101 to the recording medium 108 is also not particularly limited, but is set to favorably perform transfer and not to impair the durability of the transfer body. For this reason, it is preferable that the pressure is 9.8 $N/cm^2$ (1 $kg/cm^2$) or more and 294.2 $N/cm^2$ (30 $kg/cm^2$) or less. Incidentally, the pressure in this embodiment indicates a nip pressure between the recording medium 108 and the transfer body 101, and is calculated by performing surface pressure measurement with a surface pressure distribution measuring device, and by dividing a weight in a pressurization region by an area.

A temperature when the pressing member 106 is pressed in order to transfer the image on the transfer body 101 to the recording medium 108 is also not particularly limited, but it is preferable that the temperature is equal to or higher than a glass transition point or equal to or higher than softening point of a resin component contained in the ink.

In addition, for heating, an embodiment in which a heating means heating the image on the transfer body 101, the transfer body 101, and the recording medium 108 is provided is preferable.

The shape of the pressing member 106 is not particularly limited, and for example, a roller-like pressing member is exemplified.

<Recording Medium and Recording Medium Conveying Means>

In this embodiment, the recording medium 108 is not particularly limited, and any known recording medium can be used. An elongated object wound into the shape of a roll, or a sheet-type object cut at a predetermined dimension is exemplified as the recording medium. As a material, paper, a plastic film, a wooden board, a cardboard, a metal film, and the like are exemplified.

In addition, in FIGS. 1A and 1B, the recording medium conveying means 107 for conveying the recording medium 108 is configured by a recording medium feed roller 107*a* and a recording medium take-up roller 107*b*, but is not limited to this configuration as long as the recording medium can be conveyed.

<Control System>

Figure 3:
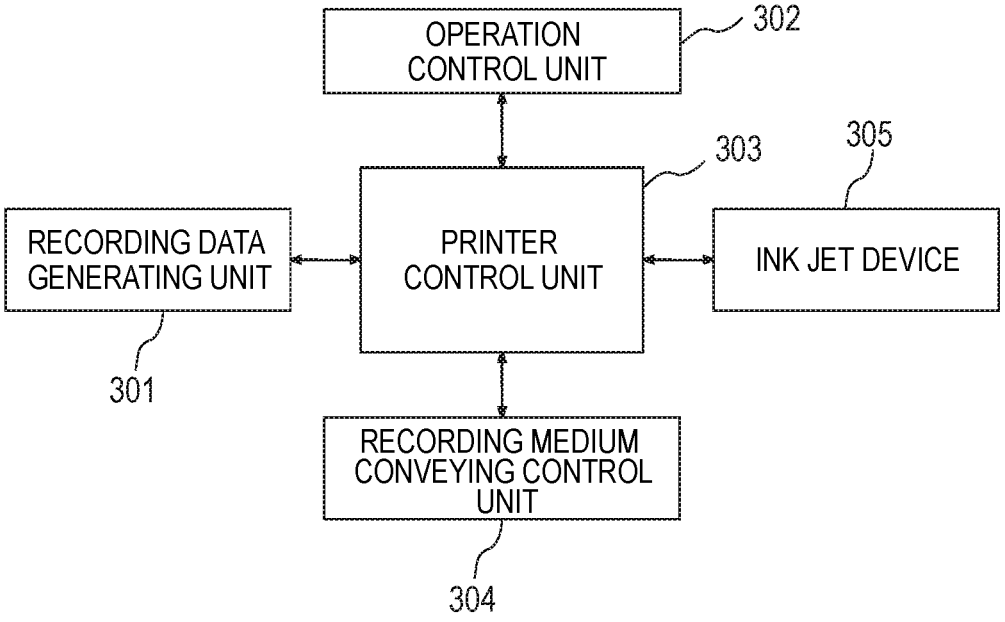
FIG. 3 is a block diagram illustrating a control system of the entire apparatus in the ink jet recording apparatuses illustrated in FIGS. 1A to 2B.

The transfer type ink jet recording apparatus in this embodiment has a control system controlling each device. FIG. 3 is a block diagram illustrating a control system of the entire apparatus in the transfer type ink jet recording apparatus illustrated in FIGS. 1A and 1B.

In FIG. 3, reference numeral 301 indicates a recording data generating unit, such as an external print server, reference numeral 302 indicates an operation control unit, such as an operation panel, reference numeral 303 indicates a printer control unit for executing a recording process, reference numeral 304 indicates a recording medium conveying control unit for conveying a recording medium, and reference numeral 305 indicates an ink jet device for performing printing.

Figure 4:
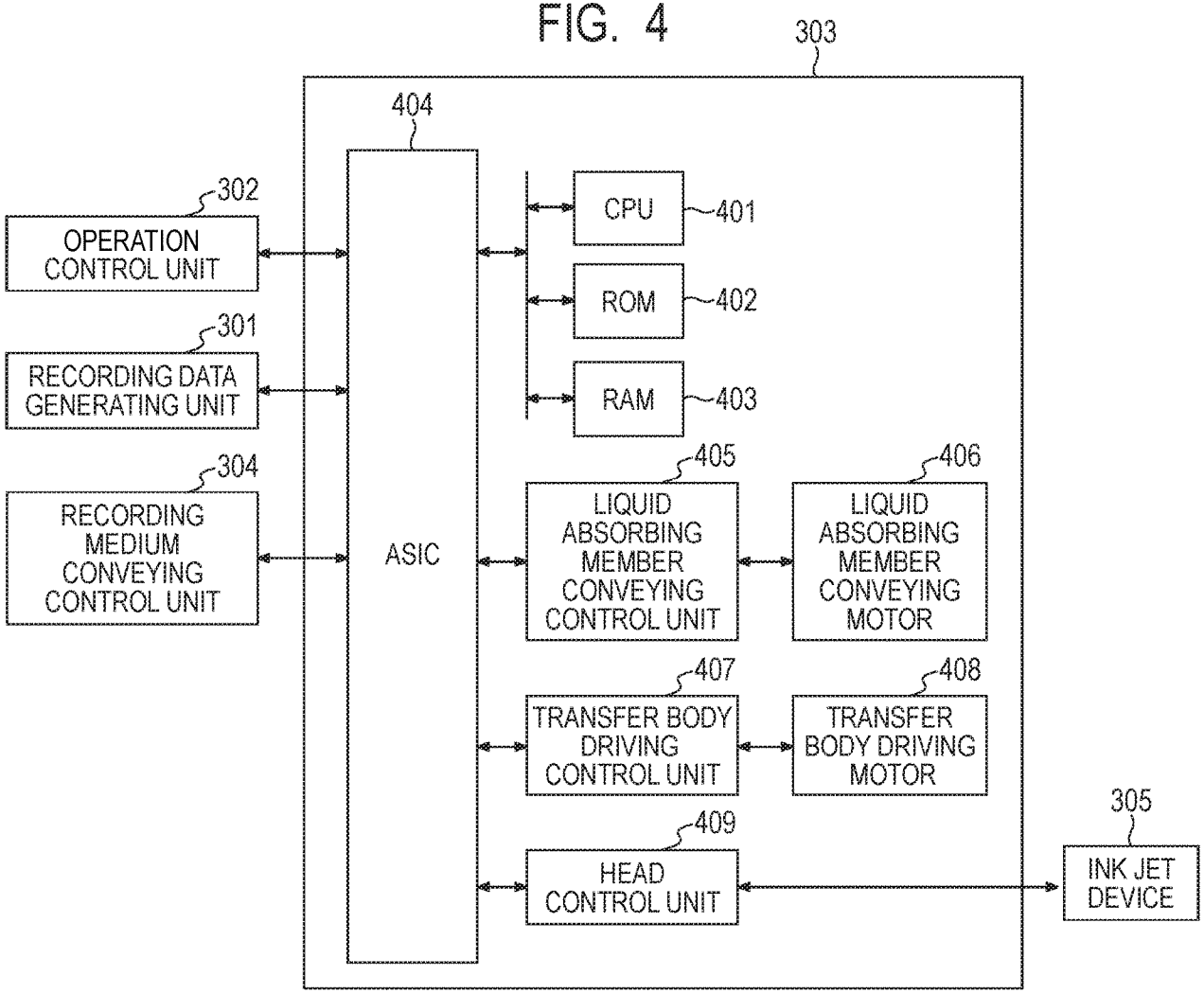
FIG. 4 is a block diagram of a printer control unit in the transfer type ink jet recording apparatus illustrated in FIGS. 1A and 1B.

FIG. 4 is a block diagram of the printer control unit in the transfer type ink jet recording apparatus of FIGS. 1A and 1B.

Reference numeral 401 indicates a CPU controlling the entire printer, reference numeral 402 indicates a ROM for storing a control program of the CPU, and reference numeral 403 indicates a RAM for executing the program. Reference numeral 404 indicates an application specific integrated circuit (ASIC) in which a network controller, a serial IF controller, a controller for generating head data, a motor controller, and the like are built. Reference numeral 405 indicates a liquid absorbing member conveying control unit for driving a liquid absorbing member conveying motor 406, and is command-controlled from the ASIC 404 through a serial IF. Reference numeral 407 indicates a transfer body driving control unit for driving a transfer body driving motor 408, and similarly, is command-controlled from the ASIC 404 through the serial IF. Reference numeral 409 indicates a head control unit, and performs final ejection data generation, driving voltage generation, or the like of the ink jet device 305.

[Direct Drawing Type Ink Jet Recording Apparatus]

As another embodiment in the present invention, a direct drawing type ink jet recording apparatus is exemplified. In the direct drawing type ink jet recording apparatus, the ink receiving medium is a recording medium on which an image is to be formed.

Figure 2A:
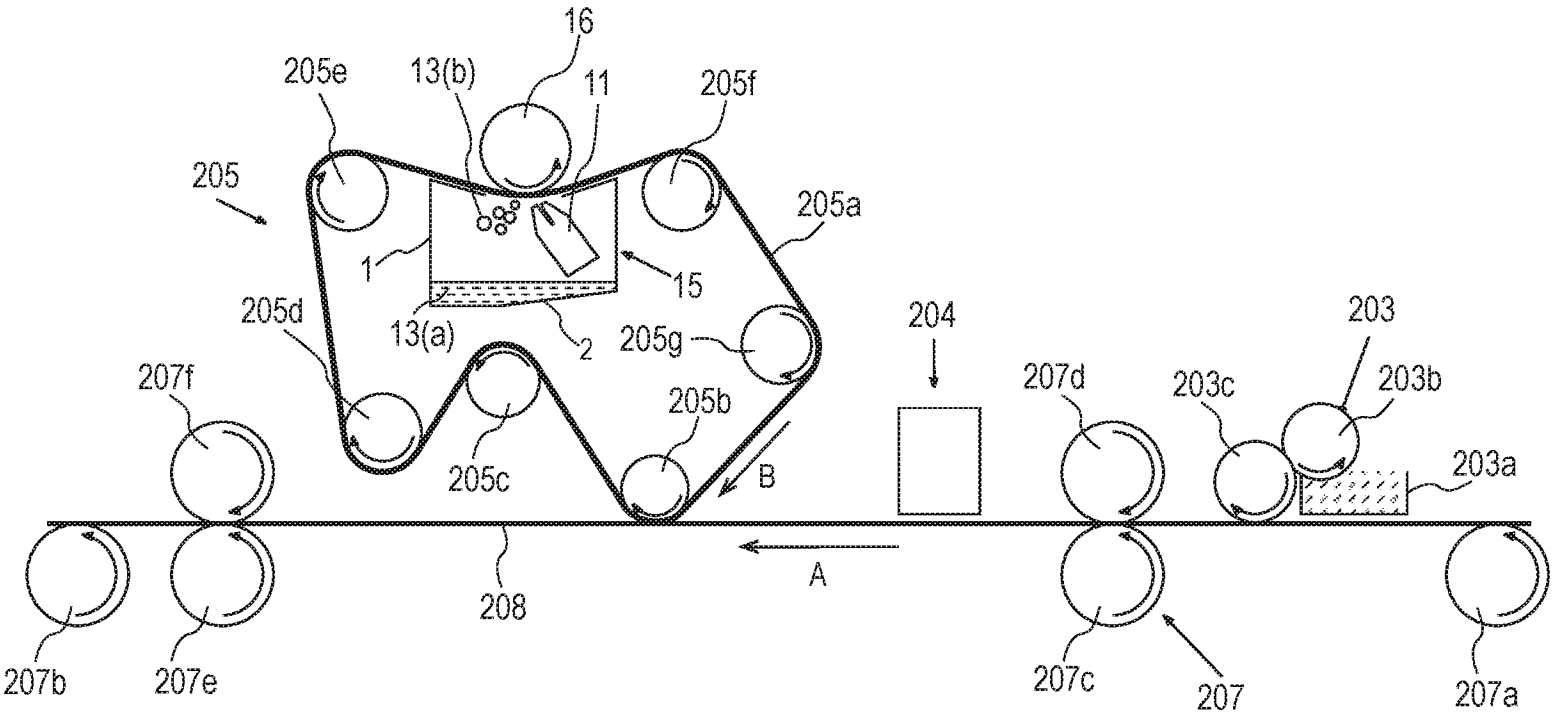
FIG. 2A is a schematic diagram illustrating an example of the configuration of a direct drawing type ink jet recording apparatus according to an embodiment of the present invention.
Figure 2B:
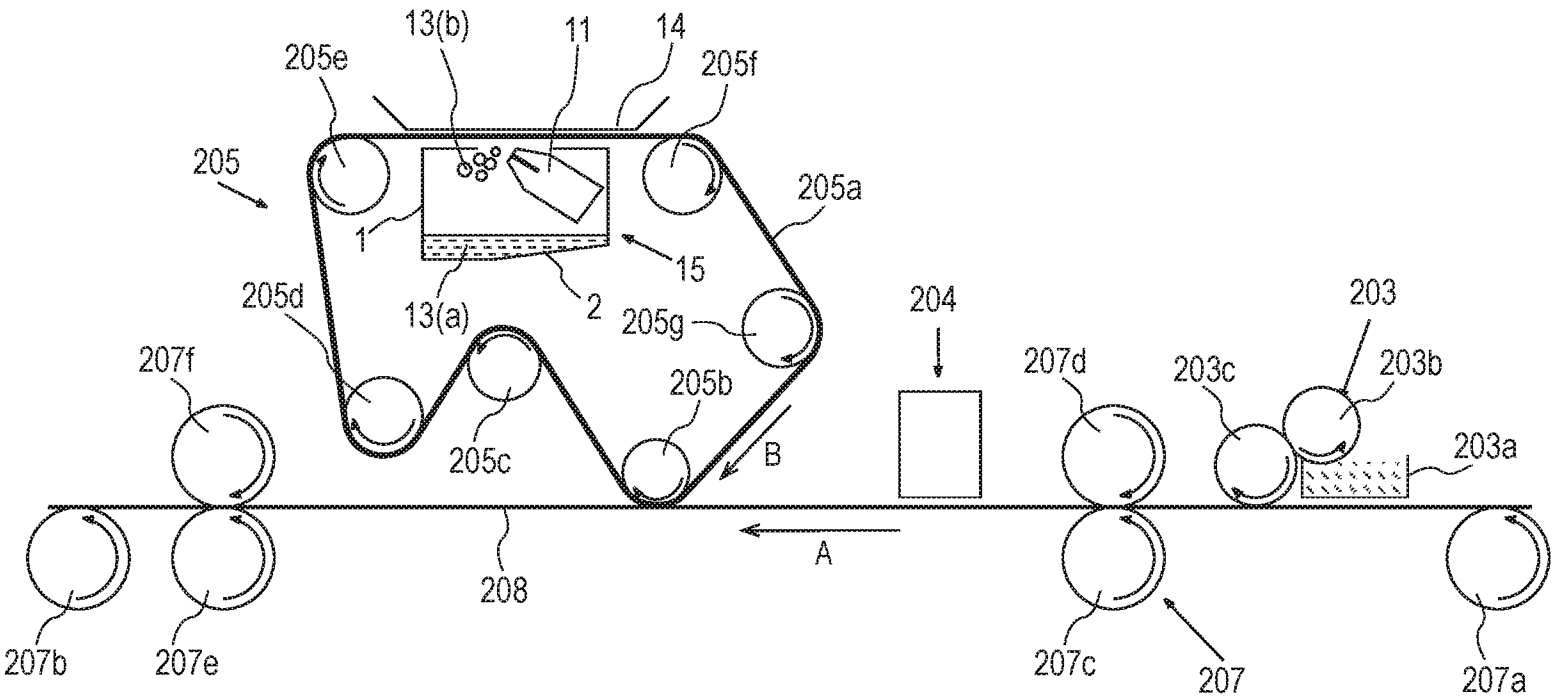
FIG. 2B is a schematic diagram illustrating an example of the configuration of the direct drawing type ink jet recording apparatus according to the embodiment of the present invention.

FIGS. 2A and 2B are schematic diagrams illustrating an example of the schematic configuration of a direct drawing type ink jet recording apparatus 200 in this embodiment. The direct drawing type ink jet recording apparatus 200 has the same apparatus configuration as in each of the transfer type ink jet recording apparatuses illustrated in FIGS. 1A and 1B, except that the direct drawing type ink jet recording apparatus 200 does not include the transfer body 101, the support member 102, and the transfer body cleaning means 109 and an image is formed on the recording medium 208 as compared to the aforementioned transfer type ink jet recording apparatus 100.

Therefore, a reaction liquid applying device 203 applying reaction liquid to the recording medium 208, an ink applying device 204 applying an ink to the recording medium 208, and a liquid absorbing device 205 absorbing a liquid component contained in the image by a liquid absorbing member 205*a* coming in contact with the image on the recording medium 208 have the same configuration in the transfer type ink jet recording apparatus, and thus, a detailed description thereof is omitted.

Incidentally, in the direct drawing type ink jet recording apparatus of this embodiment, the liquid absorbing device 205 includes the liquid absorbing member 205*a* and pressing member 205*b* for liquid absorbing that presses the liquid absorbing member 205*a* against the first image on the recording medium 208. In addition, the shapes of the liquid absorbing member 205*a* and the pressing member 205*b* are not particularly limited, and the same shapes as those of the liquid absorbing member and the pressing member which are usable in the transfer type ink jet recording apparatus can be used. Further, the liquid absorbing device 205 may include a stretching member stretching the liquid absorbing member. In FIGS. 2A and 2B, reference numerals 205*c*, 205*d*, 205*e*, 205*f*, and 205*g* indicate stretching rollers as the stretching member. The number of the stretching rollers is not limited to five in FIG. 4, and the stretching roller may be disposed in a required number according to the apparatus design.

Further, a recording medium support member (not illustrated) supporting the recording medium from the lower side may be provided at a position facing the liquid component removing unit that removes the liquid component by bringing an ink applying unit applying the ink to the recording medium 208 by the ink applying device 204 and the liquid absorbing member 205*a* into contact with the image on the recording medium. An example in which the liquid collecting device 15 including the backup roller 16 is provided is illustrated in FIG. 2A similarly to FIG. 1A and an example in which the liquid collecting device 15 including the support member 14 is provided is illustrated in FIG. 2B similarly to FIG. 1B.

<Recording Medium Conveying Device>

In the direct drawing type ink jet recording apparatus of this embodiment, a recording medium conveying device 207 is not particularly limited, and a conveying means in a known direct drawing type ink jet recording apparatus can be used. For example, as illustrated in FIGS. 2A and 2B, a recording medium conveying device including a recording medium feed roller 207*a*, a recording medium take-up roller 207*b*, and recording medium conveying rollers 207*c*, 207*d*, 207*e*, and 207*f* is exemplified.

<Control System>

The direct drawing type ink jet recording apparatus in this embodiment includes a control system controlling each device. The block diagrams illustrating the control system of the entire device in the direct drawing type ink jet recording apparatus illustrated in FIGS. 2A and 2B are as illustrated in FIG. 3, similarly to the transfer type ink jet recording apparatus illustrated in FIGS. 1A and 1B.

Figure 5:
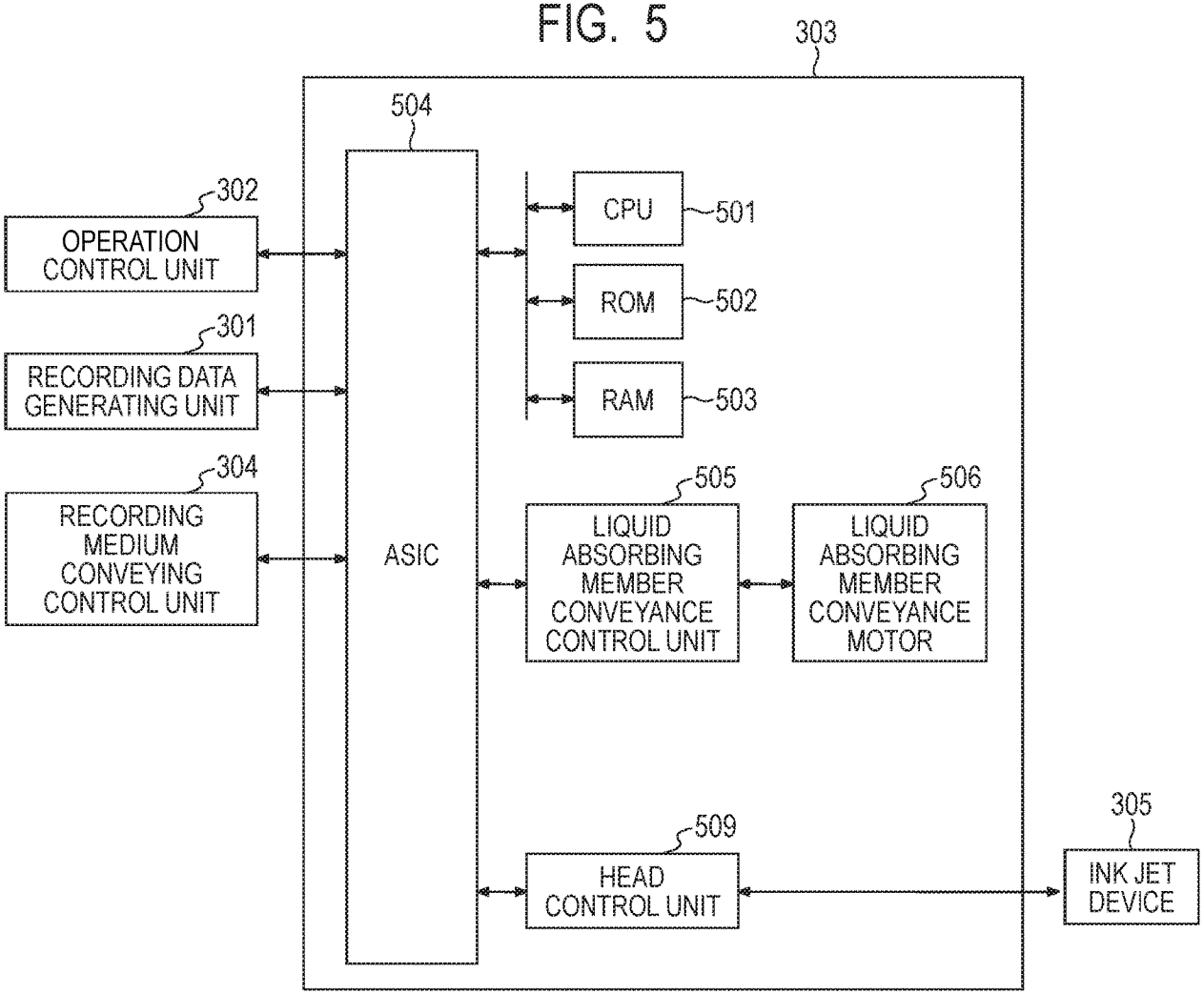
FIG. 5 is a block diagram of a printer control unit in the direct drawing type ink jet recording apparatus illustrated in FIGS. 2A and 2B.

FIG. 5 is a block diagram of a printer control unit in the direct drawing type ink jet recording apparatus of FIGS. 2A and 2B. The block diagram of FIG. 5 is the same as the block diagram of a printer control unit in the transfer type ink jet recording apparatus in FIG. 4, except that the transfer body driving control unit 407 and the transfer body driving motor 408 are not included.

That is, reference numeral 501 indicates a CPU controlling the entire printer, reference numeral 502 indicates a ROM for storing a control program of the CPU, and reference numeral 503 indicates a RAM for executing the program. Reference numeral 504 indicates an ASIC in which a network controller, a serial IF controller, a controller for generating head data, a motor controller, and the like are built. Reference numeral 505 indicates a liquid absorbing member conveying control unit for driving a liquid absorbing member conveying motor 506, and is command-controlled from the ASIC 504 through the serial IF. Reference numeral 509 indicates a head control unit, and performs final ejection data generation, driving voltage generation, or the like of the ink jet device 305.

EXAMPLES

Hereinafter, the present invention will be described in more detail using examples and comparative examples. The present invention is not limited by the following examples, unless the gist thereof is exceeded. Incidentally, in the description of the following examples, "part(s)" is on a mass basis, unless otherwise noted.

Example 1

Hereinafter, a first example of the present invention will be described.

In this example, the transfer type ink jet recording apparatus illustrated in FIGS. 1A and 1B was used.

In this example, a sheet obtained by coating a PET sheet having a thickness of 0.5 mm with silicone rubber (KE12 manufactured by Shin-Etsu Chemical Co., Ltd.) to have a thickness of 0.3 mm was used as the elastic layer of the transfer body 101. Further, a mixture of a condensate obtained by mixing glycidoxypropyltriethoxysilane and methyltriethoxysilane at a molar ratio of 1:1 and performing heating and refluxing and a photocationic polymerization initiator (SP150 manufactured by ADEKA Corporation) was prepared. Atmospheric pressure plasma treatment was performed such that the contact angle of the front surface of the elastic layer with water became 10 degrees or less, the above-described mixture was applied onto the elastic layer, a film was formed by UV irradiation (high-pressure mercury lamp, integrated exposures amount: 5000 mJ/cm$^2$) and thermal curing (150° C., 2 hours), and thus the transfer body 101 having the surface layer having a thickness of 0.5 μm formed on the elastic layer was prepared. In this configuration, although not illustrated for the sake of simplicity of explanation, a double-faced tape was used for retaining the transfer body 101 between the transfer body 101 and the support member 102.

Further, in this configuration, the front surface of the transfer body 101 was set to 60° C. by a heating means (not illustrated).

As the reaction liquid to be applied by the reaction liquid applying device 103, a reaction liquid having the following composition was used and the applied amount was set to 1 g/m$^2$.

| | |
|---|---|
| Glutaric acid | 21.0 parts |
| Glycerin | 5.0 parts |
| Surfactant (product name: MEGAFAC F444, manufactured by DIC Corporation) | 5.0 parts |
| Ion exchange water | remnant |

The ink was prepared as follows.

<Preparation of Pigment Dispersion>

Carbon black (product name: MONARCH 1100, manufactured by Cabot Corporation) (10 parts), 15 parts of resin aqueous solution (styrene-ethyl acrylate-acrylic acid copolymer, acid value: 150, weight average molecular weight (Mw): 8,000, obtained by neutralizing an aqueous solution having a resin content of 20.0 mass % with a potassium hydroxide aqueous solution), and 75 parts of pure water were mixed, the resultant mixture was charged in a batch-type vertical sand mill (manufactured by AIMEX CO., Ltd.), 200 parts of zirconia beads having a diameter of 0.3 mm were filled therein, and dispersing treatment was performed for 5 hours while water cooling was performed. This dispersion liquid was separated by centrifugation to remove coarse particles, and then a black pigment dispersion having a pigment content of 10.0 mass % was obtained.

<Preparation of Resin Particle Dispersion>

Ethyl methacrylate (20 parts), 3 parts of 2,2'-azobis-(2-methylbutyronitrile), and 2 parts of n-hexadecane were mixed and stirred for 0.5 hours. This mixture was added dropwise to 75 parts of aqueous solution of 8% styrene-butyl acrylate-acrylic acid copolymer (acid value: 130 mgKOH/g, weight average molecular weight (Mw): 7,000) and stirred for 0.5 hours. Next, an ultrasonic wave was applied for 3 hours by an ultrasonic irradiator. Subsequently, a polymerization reaction was performed at 80° C. for 4 hours under a nitrogen atmosphere, and the resultant product was filtered after being cooled at room temperature to thereby prepare a resin particle dispersion having a resin content of 25.0 mass %.

<Preparation of Ink>

The resin particle dispersion and the pigment dispersion obtained above were mixed with the following respective components. Incidentally, the remnant of ion exchange water means an amount that the total of the whole components constituting the ink becomes 100.0 mass %.

| | |
|---|---|
| Pigment dispersion (coloring material content: 10.0 mass %) | 40.0 mass % |
| Resin particle dispersion | 20.0 mass % |
| Glycerin | 7.0 mass % |
| Polyethylene glycol (number average molecular weight (Mn): 1,000) | 3.0 mass % |
| Surfactant (product name: ACETYLENOL E100, manufactured by Kawaken Fine Chemicals Co., Ltd.) | 0.5 mass % |
| Ion exchange water | remnant |

These were sufficiently stirred and dispersed, and then were subjected to pressure filtration by a micro filter having a pore size of 3.0 μm (manufactured by Fujifilm Corporation) to thereby prepare a black ink.

An ink jet head of type of performing ink ejection using an electro-thermal conversion element by an on-demand method was used as the ink applying device 104, and the amount of the ink applied was set to 20 g/m$^2$.

The liquid absorbing member 105*a* was adjusted to have the speed equal to the movement speed of the transfer body 101 by the liquid absorbing member conveying rollers 105*c*, 105*d*, and 105*e*. Similarly, the recording medium 108 was conveyed by the recording medium feed roller 107*a* and the recording medium take-up roller 107*b* such that the recording medium 108 was also adjusted to have the speed equal to the movement speed of the transfer body 101.

With such a configuration, the liquid absorbing member 105*a* was brought into contact with the first image formed on the transfer body 101 and absorbed the liquid in the first image. Regarding the nip pressure between the transfer body 101 and the liquid absorbing member 105*a*, a pressure was applied to the pressing member 105*b* such that the average pressure became 9.8 N/cm$^2$ (1 kgf/cm$^2$). Thereafter, the second image in which the liquid content was reduced was transferred to the recording medium 108. In this example, AURORA COAT paper (manufactured by Nippon Paper Industries Co., Ltd., basis weight: 104 g/m$^2$) was used as the recording medium 108.

In this example, by bringing the liquid absorbing member 105*a* into contact with the first image formed on the transfer body 101 by the ink applying device 104, excess liquid in the first image is absorbed in the liquid absorbing member 105*a*. Thereafter, the air knife 11 provided inside the liquid collecting chamber 12 is used, the liquid content osmosed inside the liquid absorbing member 105*a* is blown off by blowing pressurized air by the air knife 11 from the second surface of the liquid absorbing member 105*a*, and then the liquid content is collected in the liquid collecting chamber 12. In this example, first, the transfer type ink jet recording apparatus 100 as illustrated in FIG. 1A was tested.

In this example, the liquid absorbing member 105*a* having a configuration in which the cross-section thereof includes two layers of the absorbing layer 21 and the support layer 31, as illustrated in FIG. 6A, was used. As the absorbing layer 21, a material made of PTFE, which has a front surface subjected to hydrophilic treatment and has a pore size of 0.2 μm and a thickness of 25 μm, was used. As the support layer 31, a material which uses non-woven fabric made of polyolefin having a front surface being in a hydrophilic state and has an average pore size of 15 μm and a thickness of 100 μm was used, the joined surface of the support layer 31 was slightly melted, and thermal adhesion to the absorbing layer 21 was performed so that the support layer 31 and the absorbing layer 21 were integrated.

Figure 8A:
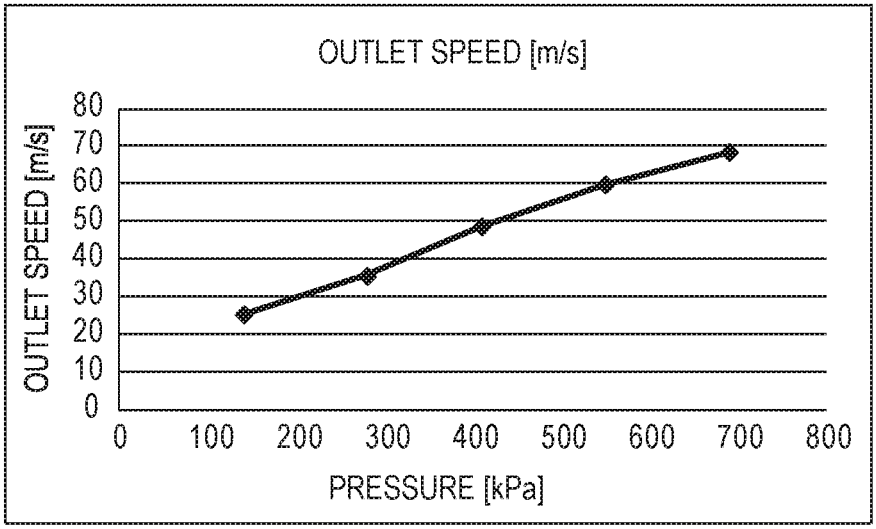
FIG. 8A is a diagram illustrating basic characteristics of an air knife used in an example and illustrates a change in outlet speed according to an injection pressure.
Figure 8B:
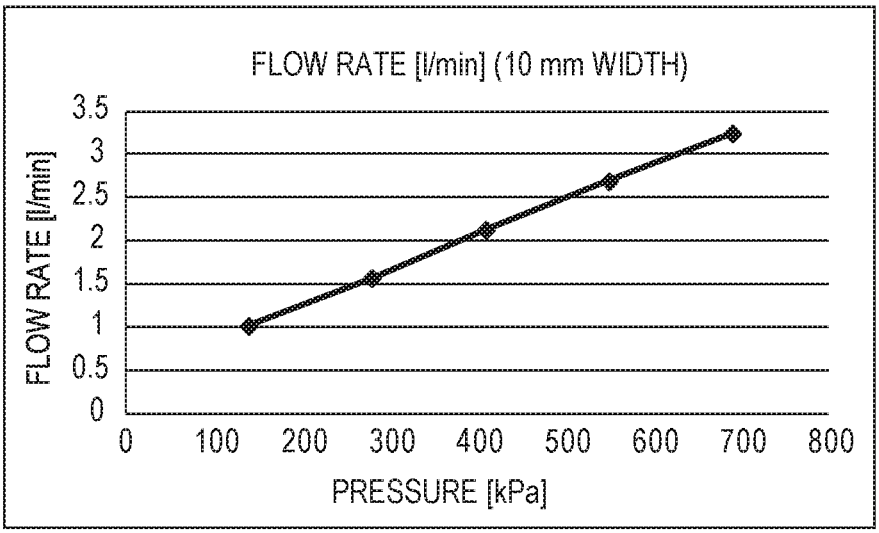
FIG. 8B is a diagram illustrating basic characteristics of the air knife used in an example and illustrates a change in flow rate according to the injection pressure.
Figure 10:
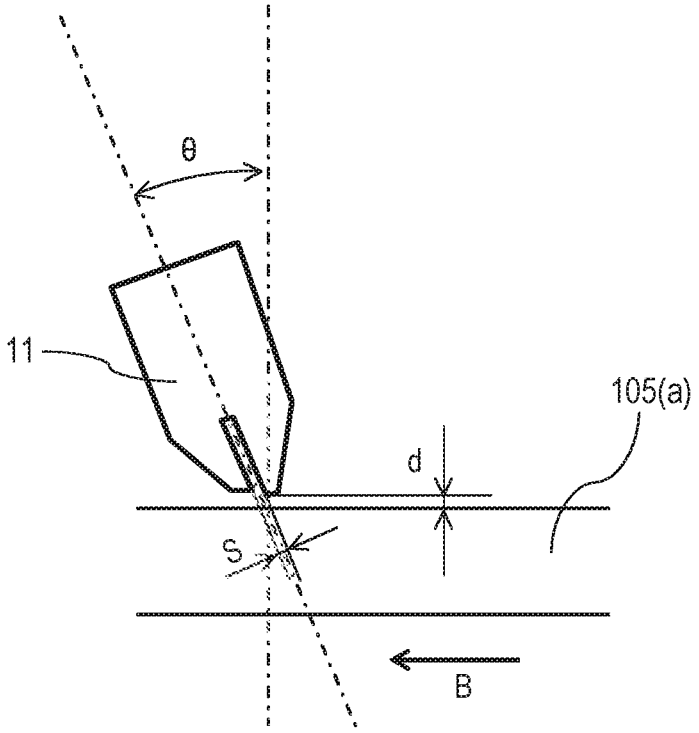
FIG. 10 is a schematic diagram describing a posture view of the air knife used in the first example.

Next, the air knife used in this example will be described. As the air knife 11, a "standard air knife made of aluminum" manufactured by CSGIKEN Co., Ltd. was used. This air knife 11 is to supply pressurized air through a tube and obtain slit-shaped air from a slit-shaped opening. The cross-sectional side view of the air knife is illustrated in FIG. 10. The width s of the slit-shaped opening can be configured to be adjusted and can be set in a range of 50 to 150 μm. A relation between a supply air pressure in a state where the slit width is set to 50 μm and an outlet speed at the opening of the air knife 11 is illustrated in FIG. 8A and a flow rate per slit length of 10 mm wide is illustrated in FIG. 8B.

The liquid collecting performance from the liquid absorbing member 105*a* was confirmed using the air knife. The fixed conditions of the confirmation test are described below.

Air knife distance (d in FIG. 10): 2 mm
Input pressure: 450 kPa
Conveyance speed of liquid absorbing member 105*a:* 2 m/s
Air knife slit width (s in FIG. 10): 100 μm
Air knife angle (θ in FIG. 10): 25 degrees Under the above-described fixed conditions, while respective parameters were appropriately changed, the mass of the liquid absorbing member 105*a* before and after liquid collecting was measured and thus the amount of the liquid collected was evaluated. The results thereof are presented in FIGS. 9A to 9E.

Figure 9A:
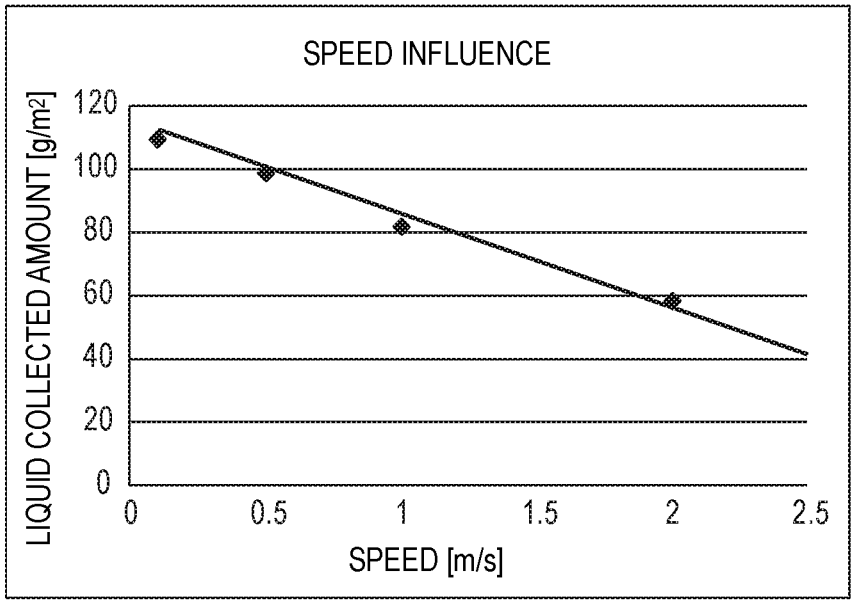
FIG. 9A is a graph showing an influence of a conveyance speed of a liquid absorbing member on liquid collecting by the air knife in a first example.

First, an influence of a conveyance speed of the liquid absorbing member 105*a* is illustrated in FIG. 9A. As the conveyance speed decreases, sweeping of the liquid was sufficiently performed, and the result that the amount of the liquid collected was large was obtained.

Figure 9B:
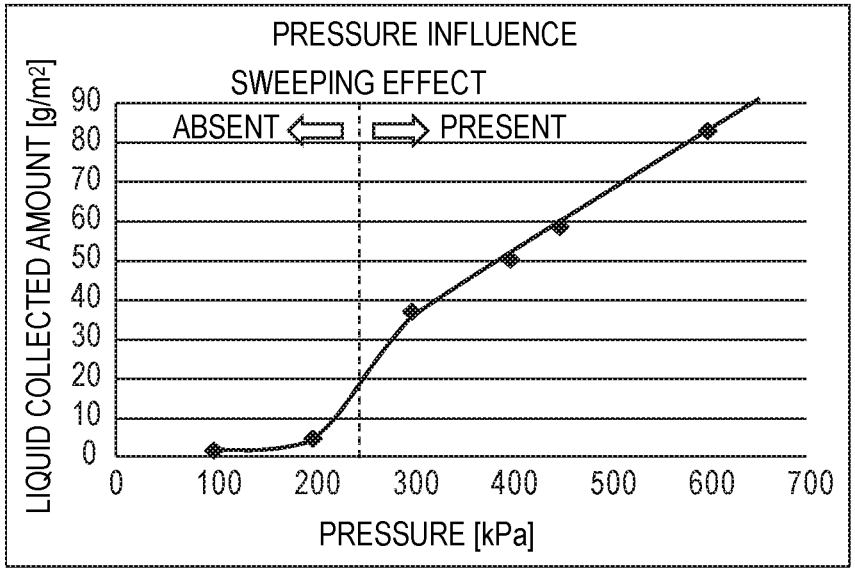
FIG. 9B is a graph showing an influence of an injection pressure of the air knife on liquid collecting in the first example.

Next, an influence of an injection pressure is illustrated in FIG. 9B. According to the increase in the injection pressure, the amount of the liquid collected is approximately linearly increased, but in a region with a low pressure, the amount of the liquid collected is rapidly decreased. This indicates that the "sweeping effect," in which the liquid 13 is extruded from the front surface of the liquid absorbing member 105*a* and swept, which has been described in FIG. 7, is observed in a region where the amount of the liquid collected is sufficient. On the other hand, in a region where the "sweeping effect" is not observed, the amount of the liquid collected is small.

Figure 9C:
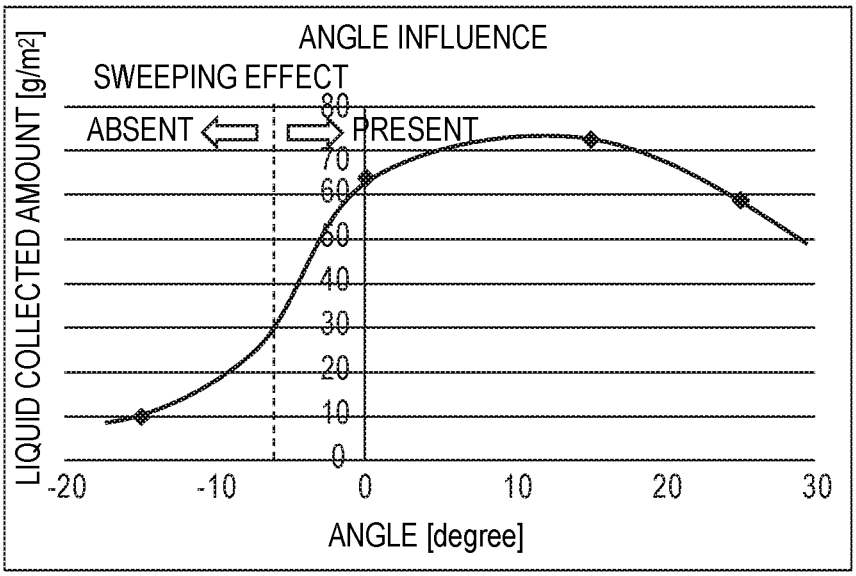
FIG. 9C is a graph showing an influence of an angle of the air knife on liquid collecting in the first example.

An influence of an angle of the air knife 11 (represented by θ in FIG. 10) is illustrated in FIG. 9C. In a condition range that the pressurized air is applied in a direction opposite to the conveyance direction of the liquid absorbing member 105*a* (θ≥0), the "sweeping effect" is observed, and in this test, a peak appears around 15 degrees. On the other hand, in a condition range of θ<0, the pressurized air is applied in a forward direction with respect to the conveyance direction of the liquid absorbing member 105*a* so that the "sweeping effect" is not sufficiently obtained and the amount of the liquid collected becomes smaller.

Figure 9D:
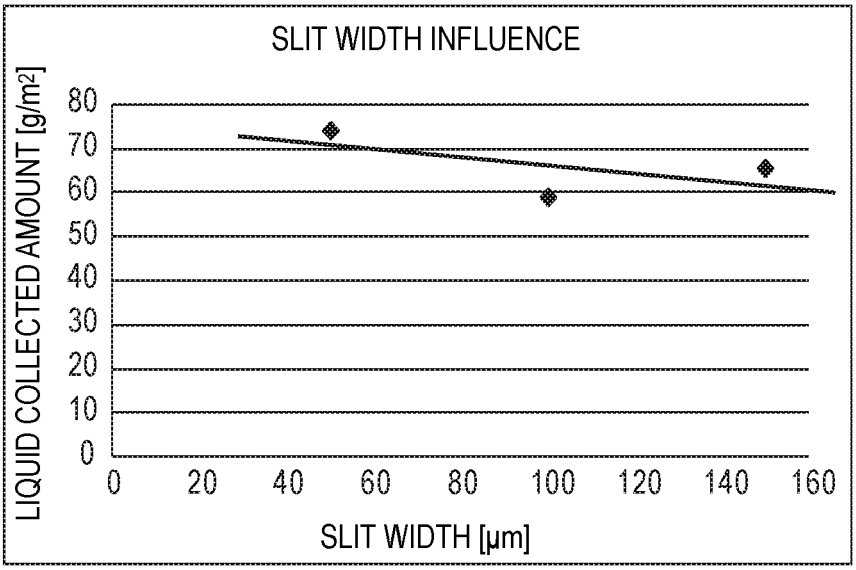
FIG. 9D is a graph showing an influence of a slit width of the air knife on liquid collecting in the first example.

An influence of a slit width s is illustrated in FIG. 9D. If the pressure of air supplied to the air knife 11 is the same, when the slit width s is small, the air speed at the slit outlet is fast, but the amount of air blown becomes smaller. On the other hand, when the slit width s is large, the air speed at the slit outlet is slow, but the amount of air blown is large. For this reason, there was not a large difference in the amount of the liquid to be collected in a slit width range of 50 to 150 μm.

Figure 9E:
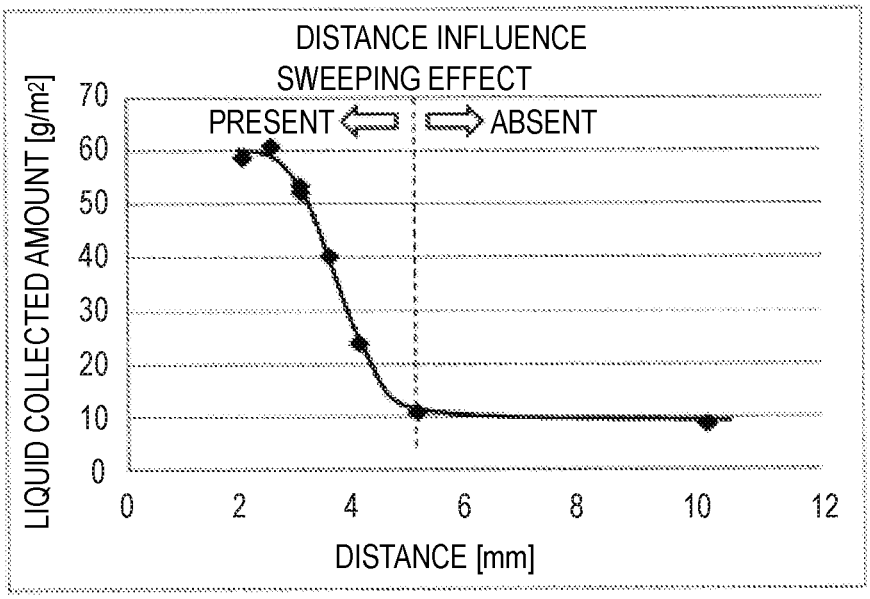
FIG. 9E is a graph showing an influence of a slit tip distance of the air knife on liquid collecting in the first example.

An influence of an air knife distance (d in FIG. 10) is illustrated in FIG. 9E. In a case where the air knife 11 is closer to the liquid absorbing member 105*a*, the "sweeping effect" is obtained and the amount of the liquid collected is satisfactory. In a case where the distance increases, the "sweeping effect" is not obtained. Thus, it was confirmed that the amount of the liquid collected is decreased.

The liquid collecting was repeatedly performed with the apparatus illustrated in FIG. 1A by using the liquid collecting device 15 using the air knife 11 described above. As a comparative example, comparison was performed to a method of bringing the air knife into contact with the liquid absorbing member from the first surface (absorbing layer 21) side, a method of squeezing the liquid absorbing member 105*a* to collect the liquid, and a method of simply drying. The evaluation results are presented in Table 1 below and the evaluation criteria are presented in Table 2 below.

TABLE 1

| | Liquid collecting means | Liquid collecting evaluation result |
|---|---|---|
| Example 1-1 | Air knife from second surface side | A |
| Comparative Example 1-1 | Air knife from first surface side | C |
| Comparative Example 1-2 | Squeezing | C |
| Comparative Example 1-3 | Drying | C |

Liquid collecting evaluation criteria
A: There is no defect in liquid removing performance in the repeated step.
C: There is a defect in liquid removing performance in the repeated step.

The second surface of the porous body of the liquid absorbing member 105*a* is set to the support layer 31 having a large average pore size, pressurized air is applied from the support layer 31 side by the air knife 11, the liquid contained in the liquid absorbing member 105*a* is swept, and then the liquid can be extruded from the second surface. In this way, by efficiently collecting the liquid in this example, the liquid absorbing from the first image by the liquid absorbing member 105*a* is stabilized, and thus a favorable image can be formed. Further, an increase in recording speed and an increase in size of a recording region can also be coped with by adjustment or the like of the ejection region of the pressurized air, the air speed or air flow rate of the pressurized air, and the angle of the pressurized air applied, and when thermal energy is not used, an increase in running cost can be suppressed.

Example 2

Hereinafter, a second example of the present invention will be described.

The difference of this example from the first example is in that the absorbing layer 21 of the liquid absorbing member 105*a* is water-repellent PTFE. In a case where the absorbing layer 21 is a water-repellent material, since the front surface is in a water-repellent state, the liquid from the first image on the transfer body 101 is popped at this state, and the liquid cannot be absorbed. In this regard, before a step of absorbing liquid from the first image is performed, ethanol is applied to the front surface of the absorbing layer 21 in advance. The cross-section of the liquid absorbing member 105*a* after the liquid absorbing member 105*a* in such a state is conveyed and the liquid from the first image on the transfer body 101 is absorbed is in a state as illustrated in FIG. 6C. In this stage, the liquid 13 osmoses to the absorbing layer 21 and the support layer 31 in a state where ethanol applied in advance and the liquid absorbed from the first image are mixed. In this state, the liquid absorbing member 105*a* is conveyed and then conveyed to the upper portion of the liquid collecting chamber 12 illustrated in FIG. 1A, that is, to the lower portion of the backup roller 16. Herein, linear pressurized air is applied by the air knife 11, and the liquid is swept. The "sweeping effect" described herein is the same as in the first example. Further, in this example, in the liquid absorbing member 105*a* after the liquid is collected by such a method, as illustrated in FIG. 6E, the liquid does not remain inside the support layer 31, and a mixed liquid of ethanol applied in advance and the liquid absorbed from the image remain inside the absorbing layer 21. For this reason, when the liquid from the image is removed at the second time and subsequent times, it is not necessary to apply preliminary penetrant such as ethanol as the pre-treatment.

The result obtained by confirming this effect will be described below.

The printing, the liquid absorbing, and the liquid collecting were repeatedly performed at a printing speed of 0.6 m/s using the apparatus illustrated in FIG. 1A. The evaluation criteria of the liquid collecting were the same criteria as those of the first example. Further, in this example, in order to confirm a difference between the hydrophilic/water-repellent absorbing layers 21, "color transfer" evaluation was added as the image evaluation. The evaluation criteria of the "color transfer" are as follows. The evaluation results are presented in Table 2.

that is, defects occurred. In addition, in Comparative Example 2-2 not providing with the absorbing layer having a fine pore size, the color transfer occurred.

As described above, in the present invention, by collecting the liquid by the air knife from the support layer side with respect to the liquid absorbing member which includes an absorbing layer having a fine pore size and a support layer having a coarse pore size, the liquid absorbing is repeatedly realized without any defect in an image occurring. In addition, by applying the liquid absorbing member including a water-repellent absorbing layer thereto, it is also not necessary to perform the pre-treatment applying preliminary penetrant every time, and thus it is possible to provide a simpler system configuration.

TABLE 2

| | Absorbing member | | | | | | | | Evaluation result | |
|---|---|---|---|---|---|---|---|---|---|---|
| | Absorbing layer | | | Support layer | | | | Liquid | | |
| | Hydrophilic/ water-repellent | Pore size [μm] | Thickness [μm] | Hydrophilic/water-repellent | Pore size [μm] | Thickness [μm] | Preliminary penetrant | collecting means | Color transfer | Liquid collecting |
| Example 2-1 | Water-repellent | 0.2 | 25 | Hydrophilic | 15 | 100 | Present (application only at first time) | Air knife from second surface | A | A |
| Example 2-2 | Hydrophilic | 0.2 | 25 | Hydrophilic | 15 | 100 | Absent | Air knife from second surface | B | A |
| Example 2-3 | Water-repellent | 0.2 | 25 | Hydrophilic | 20 | 100 | Present (application only at first time) | Air knife from second surface | A | A |
| Example 2-4 | Water-repellent | 0.2 | 25 | Hydrophilic | 30 | 100 | Present (application only at first time) | Air knife from second surface | A | A |
| Comparative Example 2-1 | Hydrophilic | 0.2 | 25 | | | | Absent | Air knife from second surface | B* | C |
| Comparative Example 2-2 | | | | Hydrophilic | 15 | 100 | Absent | Air knife from second surface | C | — |

Color transfer evaluation criteria

A: There is almost no color transfer to the absorbing member in the repeated step.

B: Acceptable level in the repeated step.

(There is slight color transfer to the absorbing member and there is no retransfer to the image.)

B*: B determination at the first time and C determination at the second time and subsequent times.

C: There is a defect in the repeated step.

(The coloring material transferred to the absorbing member is retransferred to the image.)

As presented in Table 2, as compared to the case of the hydrophilic absorbing layer 21, the case of the water-repellent absorbing layer 21 was excellent in color transfer evaluation, and in Examples 2-1 to 2-4 in which the air knife was applied from the support layer side, the result of liquid collecting was also favorable. On the other hand, in the case of providing only the absorbing layer 21 without the support layer (Comparative Example 2-1), the color transfer at the initial stage was B determination, but air of the air knife is difficult to directly enter the absorbing layer having a small pore size so that the liquid collecting is not favorably performed. For this reason, the color transfer evaluation at the second time and subsequent times was C determination,

Example 3

Hereinafter, a third example will be described.

FIG. 12A is a schematic diagram of the liquid collecting module 15 for describing the third example. The difference of this example from the first example is in that the liquid 13 swept by the air knife 11 is not caused to simply fly as the liquid droplets 13(*b*), but the liquid is absorbed once by the sponge roller 71 and the sponge roller 71 is squeezed by the sponge squeeze roller 72 so that the liquid is collected.

With such a configuration, since the liquid can be collected without causing the liquid to fly inside the liquid collecting chamber 12, the amount of the liquid to be filtered by the exhaust filter 63 becomes smaller, and as a result, this contributes to providing a system having a long life-time exhaust filter 63.

Example 4

Hereinafter, a fourth example will be described.

Figure 13:
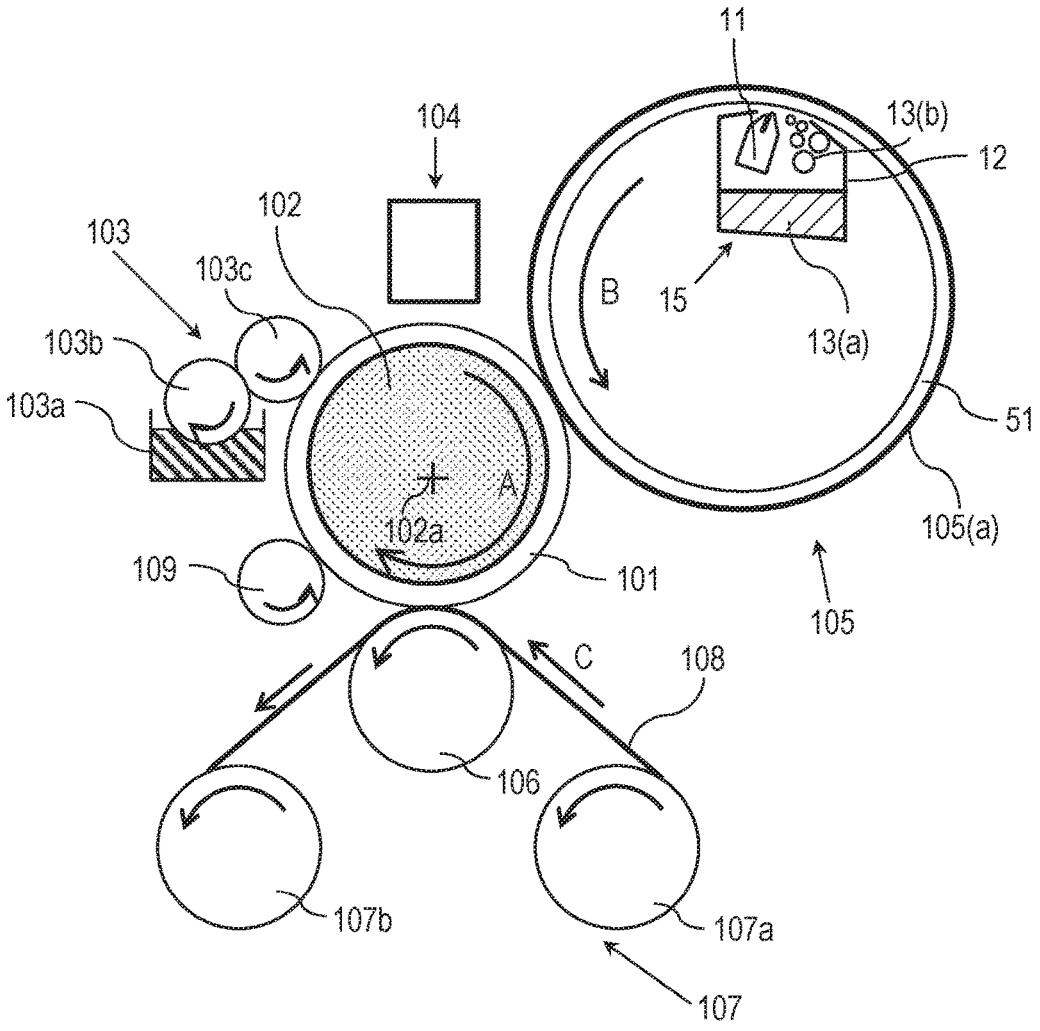
FIG. 13 is a schematic diagram of a fourth example.

FIG. 13 is a diagram for describing a fourth example. The difference of this example from the first example is in that the liquid absorbing member 105*a* is formed on the drum-shaped porous body roller 51. The porous body roller 51 may be, for example, a sintered porous body or the like obtained by forming a sphere made of SUS through sintering and polishing a front surface, or may also be formed by attaching the first layer of the liquid absorbing member 105*a* as the outer side. The liquid absorbing is performed in the first image formed on the transfer body 101 by the porous body roller 51, which has the liquid absorbing member 105*a* fixed to the front surface, coming in contact with the first image. The same liquid collecting module 15 as in the first example is provided inside the drum, and the liquid collecting is performed herein.

As described above, the present invention can be applied not only to the belt-shaped liquid absorbing member 105*a* but also to a drum-shaped liquid collecting member.

Example 5

The present invention can be applied not only to a transfer type ink jet recording apparatus but also to the direct drawing type ink jet recording apparatus illustrated in FIGS. 2A and 2B that directly coats recording medium with a reaction liquid to apply an ink.

It is confirmed that the operation and the effect of the liquid collecting module 15 are exerted similarly to the first example.

As described above, the present invention can also be applied to a direct drawing type ink jet recording apparatus.

Hereinbefore, according to the present invention, it is possible to provide an ink jet recording apparatus and an ink jet recording method which can provide a printed article with excellent image quality in response to a high-speed recording and an increase in size by absorbing at least a part of the first liquid from the first image on the ink receiving medium by the first surface of the porous body and applying pressurized air to the absorbed liquid component from the second surface of the porous body to extrude and collect the liquid component.

According to the present invention, there are provided an ink jet recording apparatus and an ink jet recording method which are capable of coping with an increase in printing speed, an increase in size of a printed article, and the like and providing a printed article with excellent image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet recording apparatus comprising:

an image forming unit that forms a first image containing a first liquid and a coloring material on an ink receiving medium;

a liquid absorbing member that has a porous body coming in contact with the first image and absorbing at least a part of the first liquid from the first image; and a liquid collecting device that collects the first liquid absorbed in the porous body, wherein the porous body has a first surface that is a side contacting the first image and a second surface opposing the first surface, an average pore size of the second surface of the porous body is larger than an average pore size of the first surface, and the liquid collecting device includes a gas ejection member that ejects gas to the second surface of the porous body to extrude the first liquid from the second surface.

2. The ink jet recording apparatus according to claim 1, wherein the liquid collecting device includes a liquid storage member that stores the first liquid extruded by the gas ejection member.

3. The ink jet recording apparatus according to claim 1, wherein the liquid absorbing member is a member that is movable in conjunction with movement of the ink receiving medium and capable of repeatedly collecting liquid using the liquid collecting device and coming in contact with first image on the ink receiving medium.

4. The ink jet recording apparatus according to claim 1, wherein the gas ejection member is an air knife that has a slit for linearly ejecting pressurized air.

5. The ink jet recording apparatus according to claim 3, wherein an ejection direction of gas ejected from the gas ejection member is a direction that is inclined in a direction opposite to a movement direction of the liquid absorbing member from a vertical direction with respect to the second surface.

6. The ink jet recording apparatus according to claim 1, wherein a gas ejection port of the gas ejection member is disposed at a distance of 5 mm or less from the second surface.

7. The ink jet recording apparatus according to claim 1, wherein the second surface of the porous body to which the gas is ejected is a surface downward in a gravitational direction and the gas ejection member ejects the gas from a lower side to an upper side in the gravitational direction.

8. The ink jet recording apparatus according to claim 2, wherein the liquid storage member stores the first liquid extruded from the second surface of the porous body and separated as liquid droplets.

9. The ink jet recording apparatus according to claim 2, wherein the liquid storage member includes an absorber that comes in contact with liquid extruded from the second surface of the porous body and absorbs the liquid.

10. The ink jet recording apparatus according to claim 2, wherein the liquid storage member includes a chamber having an opening that is open to the second surface of the porous body and the gas ejection member is included inside the chamber.

11. The ink jet recording apparatus according to claim 1, wherein the average pore size of the first surface of the porous body is 10 μm or less.

12. The ink jet recording apparatus according to claim 1, wherein the first liquid contains water, the first surface of the porous body is a water-repellent material having a contact angle with water of 90° or more, and the first surface of the porous body is pressed against the first image and comes in contact with the first image.

13. The ink jet recording apparatus according to claim 2, wherein the liquid absorbing member has a belt shape having the first surface of the porous body as an outer side and the second surface as an inner side, the ink jet recording apparatus includes a liquid absorbing device that includes the belt-shaped liquid absorbing member, a conveying member stretching the belt-shaped liquid absorbing member and capable of conveying the belt-shaped liquid absorbing member in conjunction with movement of the ink receiving medium, and a pressing member pressing the belt-shaped liquid absorbing member against the first image, and the gas ejection member and the liquid storage member of the liquid collecting device are included in the inner side of the belt-shaped liquid absorbing member.

14. The ink jet recording apparatus according to claim 2, wherein the liquid absorbing member has a drum shape having the first surface of the porous body as an outer side and the second surface as an inner side, the ink jet recording apparatus includes a liquid absorbing device that has a mechanism that causes the drum-shaped liquid absorbing member to be rotatable in conjunction with movement of the ink receiving medium, and the gas ejection member and the liquid storage member of the liquid collecting device are included in the inner side of the drum-shaped liquid absorbing member.

15. The ink jet recording apparatus according to claim 1, wherein the image forming unit includes:

a first applying device that applies a first liquid composition, which contains the first liquid or a second liquid, onto the ink receiving medium; and a second applying device that applies a second liquid composition, which contains the first liquid or the second liquid and a coloring material, onto the ink receiving medium, and the first image is a mixture of the first liquid composition and the second liquid composition and is viscously thicker than the first liquid composition and the second liquid composition.

16. The ink jet recording apparatus according to claim 1, wherein the ink receiving medium is a transfer body that temporarily holds the first image and a second image in which the first liquid is absorbed from the first image, and the second image on the transfer body is transferred onto a recording medium on which an image is to be formed.

17. The ink jet recording apparatus according to claim 1, wherein the ink receiving medium is a recording medium on which an image is to be formed.

18. An ink jet recording apparatus comprising:

an image forming unit that forms an ink image containing an aqueous liquid component and a coloring material on an ink receiving medium;

a liquid absorbing member that has a porous body condensing an ink constituting the ink image by coming in contact with the ink image and absorbing at least a part of the aqueous liquid component from the ink image; and a liquid collecting device that collects the aqueous liquid component absorbed in the porous body, wherein the porous body has a first surface that is a side contacting the ink image and a second surface opposing the first surface, an average pore size of the second surface of the porous body is larger than an average pore size of the first surface, and the liquid collecting device includes a gas ejection member that ejects gas to the second surface of the porous body to extrude the aqueous liquid component from the second surface.

19. An ink jet recording method comprising:

an image forming step of forming a first image containing a first liquid and a coloring material on an ink receiving medium;

a liquid absorbing step of bringing a liquid absorbing member having a porous body into contact with the first image and absorbing at least a part of the first liquid from the first image by the porous body; and a liquid collecting step of collecting the absorbed first liquid from the porous body, wherein the porous body has a first surface that is a side contacting the first image and a second surface opposing the first surface, an average pore size of the second surface of the porous body is larger than an average pore size of the first surface, and the liquid collecting step is to eject gas to the second surface of the porous body, extrude the first liquid from the second surface, and collect the first liquid.

20. The ink jet recording method according to claim 19, wherein the porous body is repeatedly provided to the liquid absorbing step and the liquid collecting step.

21. The ink jet recording method according to claim 19, wherein the porous body has a multi-layered configuration including a first layer constituting the first surface and a second layer supporting the first layer.

22. The ink jet recording method according to claim 19, wherein the first liquid contains water, the first surface of the porous body is a water-repellent material having a contact angle with water of 90° or more, and the first surface of the porous body is pressed against the first image and comes in contact with the first image.

23. The ink jet recording method according to claim 19, wherein in the liquid collecting step, the gas is ejected to the second surface from a lower side to an upper side in a gravitational direction while the second surface of the porous body faces downward in the gravitational direction.

24. The ink jet recording method according to claim 19, wherein the first liquid extruded from the second surface is caused to fly as liquid droplets and is then collected.

25. The ink jet recording method according to claim 19, wherein the first liquid extruded from the second surface is absorbed by an absorber and is then collected.

26. The ink jet recording method according to claim 19, wherein the first image is a mixture of the first liquid composition, which contains the first liquid or a second liquid, and a second liquid composition, which contains the first liquid or the second liquid and the coloring material, and is viscously thicker than the first liquid composition and the second liquid composition.

27. The ink jet recording method according to claim 26, wherein the image forming step includes a first applying step of applying the first liquid composition onto an ink receiving medium and a second applying step of applying the second liquid composition onto the ink receiving medium applied with the first liquid composition.

28. An ink jet recording method comprising:

an image forming step of forming an ink image containing an aqueous liquid component and a coloring material on an ink receiving medium;

a liquid absorbing step of condensing an ink constituting the ink image by bringing a liquid absorbing member having a porous body into contact with the ink image and absorbing at least a part of the aqueous liquid component from the ink image by the porous body; and a liquid collecting step of collecting the absorbed aqueous liquid component from the porous body, wherein the porous body has a first surface that is a side contacting the ink image and a second surface opposing the first surface, an average pore size of the second surface of the porous body is larger than an average pore size of the first surface, and the liquid collecting step is to eject gas to the second surface of the porous body, extrude the aqueous liquid component from the second surface, and collect the aqueous liquid component.

* * * * *